US005471861A

United States Patent [19]

Kirii

[11] Patent Number: 5,471,861

[45] Date of Patent: Dec. 5, 1995

[54] METHOD AND APPARATUS FOR DIAGNOSING PRESS CUSHIONING DEVICE, ON OPTIMUM RANGE OF BLANK-HOLDING FORCE

[75] Inventor: Kazunari Kirii, Aichi, Japan

[73] Assignee: Toyota Jidosha Kabushiki Kaisha, Japan

[21] Appl. No.: 233,800

[22] Filed: Apr. 26, 1994

[30] Foreign Application Priority Data

Apr. 28, 1993 [JP] Japan ..... 5-125292

[51] Int. Cl.[6] ..... B21D 24/08

[52] U.S. Cl. ..... 72/351; 72/453.13

[58] Field of Search ..... 72/20, 350, 351, 72/453.13

[56] References Cited

U.S. PATENT DOCUMENTS

| | | | |
|---|---|---|---|
| 3,564,883 | 7/1968 | Koors et al. . | |
| 4,601,190 | 7/1986 | Schneider et al. . | |
| 4,745,792 | 5/1988 | Story et al. | 72/351 |
| 5,138,857 | 8/1992 | Siegert . | |
| 5,241,849 | 9/1993 | Baur | 72/351 |
| 5,255,552 | 10/1993 | Bielfeldt | 72/351 |

FOREIGN PATENT DOCUMENTS

| | | |
|---|---|---|
| 0173755 | 3/1986 | European Pat. Off. . |
| 0268894 | 6/1988 | European Pat. Off. . |
| 0312809 | 4/1989 | European Pat. Off. . |
| 0453955 | 10/1991 | European Pat. Off. . |
| 0531140 | 3/1993 | European Pat. Off. . |
| 0531141 | 3/1993 | European Pat. Off. . |
| 0556390 | 8/1993 | European Pat. Off. . |
| 2667257 | 4/1992 | France . |
| 3807683 | 9/1989 | Germany . |
| 4128973A1 | 4/1992 | Germany . |
| 60-108429 | 7/1985 | Japan . |
| 61-190316 | 11/1986 | Japan . |
| 62-3219 | 1/1987 | Japan . |
| 62-20711 | 2/1987 | Japan . |
| 62-46125 | 3/1987 | Japan . |
| 63-63533 | of 1988 | Japan . |
| 63-31320 | 6/1988 | Japan . |
| 1-60721 | 4/1989 | Japan . |

OTHER PUBLICATIONS

European Search Report dated Sep. 29, 1993 (2 pages)
Communication dated Oct. 18, 1993 (1 page).
European Search Report dated Jan. 24, 1994 (2 pages)
Communication dated Mar. 22, 1994 (1 page).
European Search Report dated Aug. 22, 1994 (2 pages)
Communication dated Sep. 8, 1994 (1 page).

*Primary Examiner*—Lowell A. Larson
*Attorney, Agent, or Firm*—Finnegan, Henderson, Farabow, Garrett & Dunner

[57] ABSTRACT

Method and apparatus for diagnosing a cushioning device of a press, wherein an optimum range of a blank-holding force acting on a pressure member through a cushion platen, balancing hydraulic cylinders and cushion pins is determined on the basis of a rate of change of the detected hydraulic pressure in the hydraulic cylinders with a change of the blank-holding force, or on the basis of the detected blank-holding force and hydraulic pressure and according to a predetermined formula formulated on the basis of specifications of the cushioning device. Where the rate of change of the detected hydraulic pressure is used for diagnosing the cushioning device, the optimum range of the blank-holding force is determined if the rate of change of the hydraulic pressure with the blank-holding force is substantially constant, or is substantially equal to a reference value determined on the basis of the specifications of the cushioning device.

47 Claims, 25 Drawing Sheets

METHOD AND APPARATUS FOR DIAGNOSING PRESS CUSHIONING DEVICE, ON OPTIMUM RANGE OF BLANK-HOLDING FORCE

BACKGROUND OF THE INVENTION

1. Field of the Invention

The present invention relates generally to a cushioning device for even distribution of a blank-holding force to a blank to be processed on a press. More particularly, the present invention is concerned with a method and an apparatus that permits easy and accurate diagnosis on a range of the blank-holding force within which the blank-holding force is substantially evenly distributed on the blank.

2. Discussion of the Related Art

A press has a slide with an upper die attached thereto, which is lowered toward a lower die to perform a pressing operation on a blank or workpiece while the blank is held by and between the upper die and a pressure member. For holding the blank during a pressing cycle, there is known a cushioning device which includes (a) a cushion platen or pad which receives a blank-holding force (cushioning force) produced by suitable force generating means, (b) a plurality of balancing hydraulic cylinders disposed on the cushion platen and having respective fluid chambers which communicate with each other, and (c) a plurality of cushion pins linked at their lower ends with the respective hydraulic cylinders and supporting at their upper ends the pressure member, so that the blank-holding force produced by the force generating means is applied to the pressure member through the cushion platen, hydraulic cylinders and cushion pins. The mutually communicating hydraulic cylinders function to assure substantially even distribution of the blank-holding force on the cushion pins, that is, substantially even distribution of the blank-holding force on the pressure member.

An example of such cushioning device is disclosed in laid-open Publication No. 1-60721 (published in 1989) of unexamined Japanese Utility Model Application. This cushioning device is adapted to apply the blank-holding force to the pressure member such that the blank-holding force acts on the pressure member substantially evenly over the entire surface area of the pressure member to thereby assure substantially uniform distribution of the surface pressure of the pressure member with respect to the blank, for permitting pressing cycles to be performed with high stability of accuracy, irrespective of a length variation or difference of the cushion pins, tilting of the cushion platen with respect to the nominal plane, and other undesirable fluctuating factors of the cushioning device.

For substantially even distribution of the blank-holding force on the pressure member, it is required that the pistons of all the balancing hydraulic cylinders of the cushioning device be positioned between their upper and lower stroke ends, that is, placed at their neutral position during a pressing cycle, even in the presence of fluctuating factors such as the length variation of the cushion pins. To this end, an optimum initial hydraulic pressure Pso to be applied to the hydraulic cylinders prior to a pressing operation to establish the desired even distribution of the blank-holding force on the pressure member is determined so as to satisfy the following equation (1):

$$Xav=(Fs-n\cdot As\cdot Pso)V/n^2\cdot As^2\cdot K \quad (1)$$

where,

Xav: average operating stroke of the pistons of the hydraulic cylinders (cushion pins), As: pressure-receiving area of the piston of each hydraulic cylinder, K: volume modulas of elasticity of the working fluid, V: total fluid volume in the hydraulic cylinders and the hydraulic circuit connected thereto, Fs: blank-holding force, n: number of the hydraulic cylinders (cushion pins).

The average operating stroke Xav of the pistons of the balancing hydraulic cylinders is predetermined by experiments, for example, so as to enable all the cushion pins to abut at their upper ends on the pressure member while the pistons of the hydraulic cylinders are positioned away from their upper stroke ends by the cushion pins, but do not reach their lower stroke ends due to collision of the upper die with the pressure member through the blank during a pressing action on the blank, even if the cushion pins have different length dimensions and/or the cushion platen is tilted some angle with respect to the nominal horizontal plane. The total fluid volume V is a total volume of the working fluid which fills the fluid chambers of all the hydraulic cylinders when the pistons are located at their upper stroke ends, plus a volume of the fluid which fills the hydraulic circuit connected to the hydraulic cylinders.

For accurate calculation of the optimum initial hydraulic pressure Pso, it is required that the average operating stroke Xav, pressure-receiving area As, volume modulas of elasticity K and total fluid volume V used to calculate the optimum initial hydraulic pressure Pso be determined as precise as possible. In this sense, these values should not be theoretically calculated values but should rather be obtained by experiments or tests performed on the individual pressing machines which have specific operating characteristics. These experiments are extremely cumbersome and time-consuming. Yet, the values obtained by the cumbersome experiments may include some errors, which lead to errors in the calculated optimum initial hydraulic pressure Pso, resulting in the failure to establish even distribution of the blank-holding force Fs on the pressure member for even distribution of the blank-holding surface pressure, if the hydraulic pressure of the hydraulic cylinders is adjusted according to the calculated optimum initial pressure value Pso. Thus, the product obtained from the blank may be defective.

Once the optimum initial hydraulic pressure Pso of the balancing hydraulic cylinders is determined as described above, the blank-holding force Fs is almost evenly distributed on the pressure member even if the blank-holding force Fs is changed to some extent. However, almost even distribution of the blank-holding force Fs may be lost when the blank-holding force Fs is adjusted to an optimum level for a specific die set by using a try press, or when the force Fs is adjusted on a pressing line for some reason or other. This drawback may occur since the operator who adjusts the blank-holding force Fs does not know the range of the force Fs within which the force Fs can be almost evenly distributed on the pressure member. Although the even distribution of the blank-holding force Fs can be maintained if the optimum initial hydraulic pressure Pso is adjusted according to the above equation (1) each time the blank-holding force Fs is adjusted, this procedure upon test operation on the try press or upon adjustment of the force Fs on the production line is cumbersome and leads to low production efficiency.

SUMMARY OF THE INVENTION

It is therefore a first object of the present invention to provide a diagnostic method which permits easy and accurate diagnosis on an optimum range of the blank-holding force within which the blank-holding force can be substantially evenly distributed on the cushion pins and consequently on the pressure member.

It is a second object of this invention to provide an apparatus suitable for practicing the diagnostic method indicated above.

The first object indicated above may be achieved according to a first aspect of the present invention, which provides a method of diagnosing a cushioning device of a press having an upper die and a lower die which cooperate to perform a pressing action on a blank during a downward movement of the upper die, and a pressure member which cooperates with the upper die to hold the blank during the pressing action, the cushioning device including (a) force generating means for generating a blank-holding force, (b) a cushion platen disposed below the lower die and receiving the blank-holding force, (c) a plurality of balancing hydraulic cylinders disposed on the cushion platen and having fluid chambers communicating with each other, and (d) a plurality of cushion pins associated at lower ends thereof with the hydraulic cylinders, respectively, and supporting at upper ends thereof the pressure member, and wherein the blank is held by the upper die and the pressure member during the pressing action by the blank-holding force which is transmitted to the pressure member through the cushion platen, the hydraulic cylinders and the cushion pins such that the blank-holding force is substantially evenly distributed on all of the cushion pins by the hydraulic cylinders, the method comprising the steps of: detecting a hydraulic pressure in the balancing hydraulic cylinders during operation thereof to transmit the blank-holding force to the pressure member, as the blank-holding force is changed; and diagnosing the cushioning device on the basis of a rate of change of the detected hydraulic pressure with a change of the blank-holding force, regarding an optimum range of the blank-holding force in which the rate of change of the detected hydraulic pressure is substantially constant.

The in-process hydraulic pressure of the hydraulic cylinders detected during operation to transmit the blank-holding force changes with the blank-holding force, as shown in FIG. 1, as the blank-holding force is changed while the other operating conditions of the press such as the initial hydraulic pressure are held constant. When the blank-holding force is in a lowest range A, the pistons of all the hydraulic cylinders remain at their upper stroke ends. When the blank-holding force is in a relatively low range B higher than the lowest range A, the pistons of some of the hydraulic cylinders are moved down and located between their upper and lower stroke ends, but the pistons of the other hydraulic cylinders remain at their upper stroke ends. For instance, the pistons of the hydraulic cylinders linked with the relatively short cushion pins remain at their upper stroke ends. Thus, the positions of the pistons of the hydraulic cylinders differ depending upon the length variation of the corresponding cushion pins and the other fluctuating factors. In the range B, therefore, the blank-holding force cannot be evenly distributed on all of the cushion pins. As the blank-holding force is increased, the downward movement distances of the hydraulic cylinders are increased, whereby the number of the hydraulic cylinders whose pistons are moved down from their upper stroke ends is increased, and the hydraulic pressure in the cylinders is raised.

When the blank-holding force is raised to fall within a range C as indicated in FIG. 1, the pistons of all the hydraulic cylinders are moved and located between their upper and lower stroke ends, that is, located at their neutral positions, with none of the pistons being bottomed or reaching their lower stroke ends. In this condition, therefore, the blank-holding force is evenly distributed on all the cushion pins by the hydraulic cylinders. This range C is defined as the optimum range. Within this optimum range C, the pistons of the hydraulic cylinders are moved down as the blank-holding force is increased. The rate of change of the hydraulic pressure with a change of the blank-holding force is substantially constant as long as the blank-holding force is changed within the optimum range C. When the blank-holding force is further increased to fall within a relatively high range D, the pistons of some of the hydraulic cylinders are bottomed or located at their lower stroke ends, whereby the even distribution of the blank-holding force is lost. In this condition, a portion of the blank-holding force is only mechanically transmitted from the cushion platen to the pressure member, without the force transmission through the pressurized working fluid in the hydraulic cylinders whose pistons are bottomed. In the range D, therefore, the rate of change of the hydraulic pressure with the blank-holding force is relatively low.

The term "all the hydraulic cylinders" referred to above with respect to their neutral positions when the blank-holding force is in the optimum range C is interpreted to mean all of the hydraulic cylinders which are linked with the cushion pins and which are operated to transmit the blank-holding force to the pressure ring through the cushion pins during a pressing operation. If some of the hydraulic cylinders are not linked with the cushion pins, or if the cushion pins are provided for selected ones of the hydraulic cylinders for some reason or other, the term "all the hydraulic cylinders" referred to above does not mean all the hydraulic cylinders provided on the cushion platen.

If the length variation of the cushion pins is excessively large or if the operating stroke of the hydraulic cylinders is excessively short, the pistons of some of the hydraulic cylinders remain at their upper stroke ends while the pistons of the other hydraulic cylinders are bottomed. In such situation, the optimum range C may not be determined or found out, or two or more pseudo-optimum ranges may appear. This means some abnormality with the cushioning device.

It will be understood from the above description that the range of the blank-holding force within which the rate of change of the hydraulic pressure detected as the blank-holding force is changed is substantially constant can be defined as the optimum range C as indicated in FIG. 1. To detect the rate of change of the hydraulic pressure as the blank-holding force is changed, the blank-holding force per se need not be directly controlled. Where the force generating means for generating the blank-holding force uses a cushioning pneumatic cylinder, for example, it is possible that the hydraulic pressure of the balancing hydraulic cylinders on the cushion platen is detected as the pneumatic pressure of the cushioning pneumatic cylinder is changed. In this instance, the diagnosis on the optimum range of the blank-holding force may be effected on the basis of the rate of change of the detected hydraulic pressure with a change of the pneumatic pressure. Where the force generating means uses a cushioning hydraulic cylinder which is adapted to discharge the pressurized working fluid at a given relief pressure to regulate the blank-holding force, it is possible that the hydraulic pressure of the balancing hydraulic cylinders is detected as the relief pressure of the cushioning hydraulic cylinder is changed. In this case, the diagnosis is effected on the basis of the rate of change of the detected hydraulic pressure with a change of the relief pressure of the cushioning hydraulic cylinder. Where the blank-holding force, pneumatic pressure of the cushioning pneumatic cylinder or hydraulic pressure of the cushioning hydraulic cylinder is incremented or decremented by a predetermined increment or decrement amount, the diagnosis on the optimum range of the blank-holding force may be effected depending upon whether the amount of change of the hydraulic pressure of the balancing hydraulic cylinders for each change of the blank-holding force is substantially constant or not.

If the blank-holding force is held within the optimum range as described above, the blank-holding force generated by the force generating means is substantially evenly distributed by the hydraulic cylinders on all of the cushion pins. When a die set is prepared, the optimum blank-holding force suitable for performing an intended pressing operation using the die set can be found by changing the blank-holding force within the optimum range which can be found out according to the present method. Further, the present method is applicable to an actual production run of the press, to adjust the blank-holding force to the optimum value. If the blank-holding force suitable for a specific pressing operation (on a specific blank using a specific die set) cannot be found within the optimum range determined according to the present method, the number of the cushion pins (i.e., the number of the effective hydraulic cylinders linked with the cushion pins) and/or the initial hydraulic pressure of the balancing hydraulic cylinders is/are adjusted to shift the optimum range of the blank-holding range, so that the suitable blank-holding force for the specific pressing operation falls within the re-established optimum range. Once the optimum range of the blank-holding force is determined, the optimum range of the hydraulic pressure can be determined since the relationship between the blank-holding force and the hydraulic pressure is known. Therefore, it is possible to check whether the hydraulic pressure suitable for a specific pressing operation falls within the optimum range. By checking the hydraulic pressure, it is possible to find out any abnormality associated with the hydraulic cylinders such as entry of foreign matters in the hydraulic cylinders, which may lead to a defective pressing operation. Further, the actual in-process blank-holding force can be obtained from the detected hydraulic pressure of the hydraulic cylinders. If the optimum range of the blank-holding force cannot be found after the diagnosis on the basis of the rate of change of the hydraulic pressure with a change of the blank-holding force, this indicates the presence of some abnormality associated with the cushioning device.

As described above, the present diagnostic method permits easy and accurate diagnosis on the optimum range of the blank-holding force (optimum range of the hydraulic pressure) within which the blank-holding force is substantially evenly distributed by the balancing hydraulic cylinders on all of the cushion pins.

The second object indicated above may be achieved according to a second aspect of this invention, which provides a diagnosing apparatus constructed as illustrated in FIG. 2A, which is adapted to diagnose a cushioning device of a press having an upper die and a lower die which cooperate to perform a pressing action on a blank during a downward movement of the upper die, and a pressure member which cooperates with the upper die to hold the blank during the pressing action, the cushioning device including (a) force generating means for generating a blank-holding force, (b) a cushion platen disposed below the lower die and receiving the blank-holding force, (c) a plurality of hydraulic cylinders disposed on the cushion platen and having fluid chambers communicating with each other, and (d) a plurality of cushion pins associated at lower ends thereof with the hydraulic cylinders, respectively, and supporting at upper ends thereof the pressure member, and wherein the blank is held by the upper die and the pressure member during the pressing action by the blank-holding force which is transmitted to the pressure member through the cushion platen, the hydraulic cylinders and the cushion pins such that the blank-holding force is substantially evenly distributed on all of the cushion pins by the hydraulic cylinders, the apparatus comprising: (i) force changing means for changing the blank-holding force generated by the force generating means; (ii) hydraulic pressure detecting means for detecting the hydraulic pressure during operation thereof to transmit the blank-holding force to the pressure member, as the blank-holding force is changed; (iii) change rate calculating means for calculating a rate of change of the hydraulic pressure detected by the hydraulic pressure detecting means, as the blank-holding force is changed; (iv) diagnosing means for diagnosing the cushioning device on the basis of the rate of change of the detected hydraulic pressure calculated by the change rate calculating means, regarding an optimum range of the blank-holding force in which the rate of change of the detected hydraulic pressure is substantially constant; and (v) indicating means for indicating a result of a diagnosis effected by the diagnosing means.

The apparatus constructed as described above according to the second aspect of the invention is suitable for practicing the above method according to the first aspect of the invention. In the present apparatus, the blank-holding force generated by the force generating means is detected by the hydraulic pressure detecting means as the blank-holding force is changed by the force changing means. The rate of change of the detected hydraulic pressure with a change of the blank-holding force is calculated by the change rate calculating means. The diagnosing means diagnoses the cushioning device on the basis of the calculated rate of change of the hydraulic pressure detected as the blank-holding force is changed, so that the indicating means indicates the result of the diagnosis effected by the diagnosing means, regarding the optimum range of the blank-holding force in which the rate of change of the hydraulic pressure is substantially constant. If the rate of change of the detected hydraulic pressure is substantially constant in a given range of the blank-holding force, that range of the blank-holding force is determined as the optimum range in which the blank-holding force is substantially evenly distributed by the hydraulic cylinders on all the cushion pins. Thus, the present apparatus permits easy and accurate diagnosis on the optimum range of the blank-holding force.

The first object indicated above may also be achieved according to a third aspect of the present invention, which provides a method of diagnosing a cushioning device of a press having an upper die and a lower die which cooperate to perform a pressing action on a blank during a downward movement of the upper die, and a pressure member which cooperates with the upper die to hold the blank during the pressing action, the cushioning device including (a) force generating means for generating a blank-holding force, (b) a cushion platen disposed below the lower die and receiving the blank-holding force, (c) a plurality of balancing hydraulic cylinders disposed on the cushion platen and having fluid chambers communicating with each other, and (d) a plurality of cushion pins associated at lower ends thereof with the hydraulic cylinders, respectively, and supporting at upper ends thereof the pressure member, and wherein the blank is held by the upper die and the pressure member during the pressing action by the blank-holding force which is transmitted to the pressure member through the cushion platen, the hydraulic cylinders and the cushion pins such that the blank-holding force is substantially evenly distributed on all of the cushion pins by the hydraulic cylinders, the method comprising the steps of: detecting a hydraulic pressure in the balancing hydraulic cylinders during operation thereof to transmit the blank-holding force to the pressure member, as the blank-holding force is changed; calculating a reference value on the basis of specifications of the cushioning device, the reference value representing a rate of change of the detected hydraulic pressure with a change of the blank-holding force which occurs within an optimum range in which the blank-holding force is substantially evenly distributed on all of the cushion pins by the hydraulic cylinders; calculating the rate of change of the detected hydraulic pressure as the blank-holding force is changed; and diagnosing the cushioning device such that a range of the blank-holding force in which the calculated rate of change of the detected hydraulic pressure is substantially equal to the reference value is determined as the optimum range of the blank-holding force.

Within the optimum range C of the blank-holding force indicated in FIG. 1 described above, the following equation (2) is satisfied:

$$Fs=n\cdot As\cdot Psx-n\cdot Wp-Wr \quad (2)$$

where,

Fs: blank-holding force acting on the pressure member,

Wr: weight of the pressure member,

As: pressure-receiving area of each balancing hydraulic cylinder,

Psx: hydraulic pressure in the hydraulic cylinders,

Wp: average weight of the cushion pins, n: number of the cushion pins (number of hydraulic cylinders linked with the cushion pins).

The above equation (2) can be converted into the following equation (3):

$$Psx(1/n\cdot As)Fs+(n\cdot Wp+Wr)/n\cdot As \quad (3)$$

It follows from the above equation (3) that the hydraulic pressure Psx changes at a rate of 1/n·As with respect to the blank-holding force Fs. Consequently, if the rate of change of the hydraulic pressure Psx which is detected as the blank-holding force Fs is changed is substantially equal to 1/n·As over a certain range of the blank-holding force, that range can be determined as the optimum range in which the blank-holding force is substantially evenly distributed on all the cushion pins by the balancing hydraulic cylinders. The rate of change 1/n·As corresponds to the reference value with which the calculated rate of change of the hydraulic pressure Psx is compared by the diagnosing means to effect a diagnosis on the optimum range. The reference value may be determined or calculated on the basis of the pressure-receiving area As of the hydraulic cylinders and the number n of the cushion pins. Where the amount of change AFs of the blank-holding force Fs is constant, the diagnosis on the optimum range C can be effected depending upon whether the calculated amount of change ΔPsx of the detected hydraulic pressure Psx is substantially equal to the reference value ΔFs/n·As.

If it is difficult to directly detect the blank-holding force Fs acting on the pressure ring, and where the force generating means uses a cushioning pneumatic cylinder to generate the blank-holding force Fs, for example, the diagnosis may be made on the basis of the rate of change ΔPsx of the hydraulic pressure Psx with a change of a pneumatic pressure Pa of the pneumatic cylinder. In this case, the following equation (5) is obtained from the following equation (4) and the above equation (2):

$$Fs=Aa\cdot Pa-Wa-n\cdot Wp-Wr \quad (4)$$

$$Psx=(Aa/n\cdot As)Pa-Wa/n\cdot As \quad (5)$$

where,

Aa: pressure-receiving area of the pneumatic cylinder,

Wa: total weight of the cushion platen and hydraulic cylinders.

If the rate of change ΔPsx of the hydraulic pressure Psx detected as the pneumatic pressure Pa is changed is substantially equal to the value Aa/n·As over a certain range of the pneumatic pressure Pa, that range can be considered as the optimum range C of the pneumatic pressure Pa in which the blank-holding force Fs is substantially evenly distributed on all of the cushion pins. The value Aa/n·As is the reference value, which may be obtained from the pressure-receiving areas Aa, As of the hydraulic and pneumatic cylinders and the number n of the cushion pins. Where the force generating means uses a cushioning hydraulic cylinder adapted to discharge the pressurized working fluid at a predetermined relief pressure to regulate the blank-holding force, the diagnosis may be made in the same manner as described above, except that the pneumatic pressure Pa and pressure-receiving area Aa of the pneumatic cylinder are replaced by the relief pressure indicated above and the pressure-receiving area of the cushioning hydraulic cylinder.

The present diagnostic method according to the third aspect of this invention also permits easy and accurate diagnosis on the optimum range of the blank-holding force within which the blank-holding force is substantially evenly distributed on all the cushion pins by the balancing hydraulic cylinders. Since the diagnosis is effected by comparing the calculated rate of change ΔPsx of the hydraulic pressure Psx with the reference value, the determination as to whether a certain range of the blank-holding force Fs is held within the optimum range or not can be made by detecting two values of the hydraulic pressure Psx corresponding to respective different values of the blank-holding force which define the above-indicated range on which the above-indicated determination is made. The present arrangement facilitates the diagnosis, for example, permits the blank-holding force to be changed by a larger amount for each calculating of the rate of change of the hydraulic pressure, as compared with the arrangement according to the first aspect of the invention which requires detection of at least three values of the hydraulic pressure corresponding to respective at least three different values of the blank-holding force.

The second object indicated above may also be achieved according to a fourth aspect of this invention, which provides a diagnosing apparatus constructed as illustrated in FIG. 2B, which is adapted to diagnose a cushioning device of a press having an upper die and a lower die which cooperate to perform a pressing action on a blank during a downward movement of the upper die, and a pressure member which cooperates with the upper die to hold the blank during the pressing action, the cushioning device including (a) force generating means for generating a blank-holding force, (b) a cushion platen disposed below the lower die and receiving the blank-holding force, (c) a plurality of balancing hydraulic cylinders disposed on the cushion platen and having fluid chambers communicating with each other, and (d) a plurality of cushion pins associated at lower ends thereof with the hydraulic cylinders, respectively, and supporting at upper ends thereof the pressure member, and wherein the blank is held by the upper die and the pressure member during the pressing action by the blank-holding force which is transmitted to the pressure member through the cushion platen, the hydraulic cylinders and the cushion pins such that the blank-holding force is substantially evenly distributed on all of the cushion pins by the hydraulic cylinders, the apparatus comprising: (i) force changing means for changing the blank-holding force generated by the force generating means; (ii) hydraulic pressure detecting means for detecting a hydraulic pressure in the balancing hydraulic cylinders during operation thereof to transmit the blank-holding force to the pressure member, as the blank-holding force is changed; (iii) reference calculating means for calculating a reference value on the basis of specifications of the cushioning device, the reference value representing a rate of change of the detected hydraulic pressure with a change of the blank-holding force which occurs within an optimum range in which the blank-holding force is substantially evenly distributed on all of the cushion pins by the hydraulic cylinders; (iv) change rate calculating means for calculating the rate of change of the detected hydraulic pressure as the blank-holding force is changed; (v) diagnosing means the cushioning device such that a range of the blank-holding force in which the calculated rate of change of the detected hydraulic pressure is substantially equal to the reference value is determined as the optimum range; and (vi) indicating means for indicating a result of a diagnosis effected by the diagnosing means.

The apparatus constructed as described above according to the fourth aspect of the invention is suitable for practicing the above method according to the third aspect of the invention. In the present apparatus, the hydraulic pressure in the balancing hydraulic cylinders is detected by the hydraulic pressure detecting means as the blank-holding force is changed by the force changing means. The rate of change of the hydraulic pressure with a change of the blank-holding force is calculated by the change rate calculating means, and the calculated rate of change of the hydraulic pressure is compared with the reference by the diagnosing means to diagnose the cushioning device such that the range in which the calculated rate of change of the hydraulic pressure is substantially equal to the reference value calculated by the reference calculating means is determined as the optimum range in which the blank-holding force generated by the force generating means is substantially evenly distributed on all the cushion pins by the balancing hydraulic cylinders. The indicating means indicates a result of the diagnosis made by the diagnosing means. For instance, the indicating means indicates the determined optimum range. This arrangement according to the fourth aspect of the invention assures easy and accurate diagnosis on the optimum range of the blank-holding force, as described above with respect to the diagnosing method according to the third aspect of the invention. Unlike the diagnosing apparatus according to the second aspect of the invention which requires detection of at least two three values of the hydraulic pressure, the present apparatus according to the fourth aspect of the invention requires at least two values of the hydraulic pressure corresponding to at least two different values of the blank-holding force. In this sense, the amount of change of the blank-holding force for each calculation of the rate of change of the hydraulic pressure can be made larger, whereby the diagnosis is facilitated.

The first object indicated above may also be achieved according to a fifth aspect of the present invention, which provides a method of diagnosing a cushioning device of a press having an upper die and a lower die which cooperate to perform a pressing action on a blank during a downward movement of the upper die, and a pressure member which cooperates with the upper die to hold the blank during the pressing action, the cushioning device including (a) force generating means for generating a blank-holding force, (b) a cushion platen disposed below the lower die and receiving the blank-holding force, (c) a plurality of balancing hydraulic cylinders disposed on the cushion platen and having fluid chambers communicating with each other, and (d) a plurality of cushion pins associated at lower ends thereof with the hydraulic cylinders, respectively, and supporting at upper ends thereof the pressure member, and wherein the blank is held by the upper die and the pressure member during the pressing action by the blank-holding force which is transmitted to the pressure member through the cushion platen, the hydraulic cylinders and the cushion pins such that the blank-holding force is substantially evenly distributed on all of the cushion pins by the hydraulic cylinders, the method comprising the steps of: detecting the blank-holding force generated by the force generating means; detecting a hydraulic pressure in the balancing hydraulic cylinders during operation thereof to transmit the blank-holding force to the pressure member; diagnosing the cushioning device such that the detected blank-holding force is held within an optimum range in which the blank-holding force is substantially evenly distributed on all of the cushion pins by the balancing hydraulic cylinders, if the detected blank-holding force and the detected hydraulic pressure of the hydraulic cylinders satisfy a predetermined formula which is formulated on the basis of specifications of the cushioning device.

Within the optimum range C of FIG. 1 in which the blank-holding force is substantially evenly distributed on all the cushion pins by the balancing hydraulic cylinders, the above equation (2) is satisfied, and therefore the diagnosis on the optimum range C can be effected depending upon whether the detected blank-holding force Fs and the detected hydraulic pressure Psx substantially satisfy the equation (2). If it is difficult to directly detect the blank-holding force Fs, and when the force generating means uses a cushioning pneumatic cylinder to generate the blank-holding force Fs, the diagnosis may be effected on the basis of the detected hydraulic pressure and the detected pneumatic pressure of the cushioning pneumatic cylinder in place of the blank-holding force Fs, and depending upon whether the detected hydraulic and pneumatic pressures satisfies the equation (5), that is, satisfies the following formula (6).

$$|Aa \cdot Pa - Wa - n \cdot As \cdot Psx| \leqq \gamma \quad (6)$$

The value $\gamma$ in the above formula (6) represents a predetermined tolerance value. Where the force generating means uses a cushioning hydraulic cylinder adapted to discharge the pressurized working fluid at a predetermined relief pressure to regulate the blank-holding force, the diagnosis may be made in the same manner as described above with respect to the cushioning pneumatic cylinder, except that the relief pressure of the cushioning hydraulic cylinder is used in place of the pneumatic pressure of the cushioning pneumatic cylinder. The equation (2) or formula (6) represents the condition that should be satisfied when the detected blank-holding force (or the pneumatic pressure or relief pressure indicated above) falls within the optimum range C.

The present diagnostic method according to the fifth aspect of this invention also assures easy and accurate diagnosis of the cushioning device on the optimum range in which the blank-holding force is substantially evenly distributed on all the cushion pins by the balancing hydraulic cylinders. Further, the present method does not require detection of two or more values of the hydraulic pressure of the balancing hydraulic cylinders corresponding to different values of the blank-holding force. In other words, the present method permits a diagnosis as to whether any given value of the blank-holding force detected is held within the optimum range C or not. The diagnosis may be made by detecting the initial values of the blank-holding force and hydraulic pressure of the balancing hydraulic cylinders, and even during an actual pressing operation to check if the blank-holding force used for the action pressing action is in the optimum range or not. The diagnosis may also be made to find out a range of the vertical movement of the press slide which corresponds to the optimum range of the blank-holding force. In this case, the blank-holding force and hydraulic pressure are detected at a predetermined interval as the press slide is reciprocated in the inching mode.

The second object indicated above may also be achieved according to a sixth aspect of this invention, which provides a diagnosing apparatus constructed as illustrated in FIG. 2C, which is adapted to diagnose a cushioning device of a press having an upper die and a lower die which cooperate to perform a pressing action on a blank during a downward movement of the upper die, and a pressure member which cooperates with the upper die to hold the blank during the pressing action, the cushioning device including (a) force generating means for generating a blank-holding force, (b) a cushion platen disposed below the lower die and receiving the blank-holding force, (c) a plurality of balancing hydraulic cylinders disposed on the cushion platen and having fluid chambers communicating with each other, and (d) a plurality of cushion pins associated at lower ends thereof with the hydraulic cylinders, respectively, and supporting at upper ends thereof the pressure member, and wherein the blank is held by the upper die and the pressure member during the pressing action by the blank-holding force which is transmitted to the pressure member through the cushion platen, the hydraulic cylinders and the cushion pins such that the blank-holding force is substantially evenly distributed on all of the cushion pins by the hydraulic cylinders, the apparatus comprising: (i) force detecting means for detecting the blank-holding force generated by the force generating means; (ii) hydraulic pressure detecting means for detecting a hydraulic pressure in the balancing hydraulic cylinders during operation thereof to transmit the blank-holding force to the pressure member; and (iii) diagnosing means for diagnosing the cushioning device such that the detected blank-holding force is held within an optimum range in which the blank-holding force is substantially evenly distributed on all of the cushion pins by the balancing hydraulic cylinders, if the detected blank-holding force and the detected hydraulic pressure of the hydraulic cylinders satisfy a predetermined formula which is formulated on the basis of specifications of the cushioning device.

In the present diagnosing apparatus constructed as described above according to the sixth aspect of this invention, the blank-holding force is detected by the force detecting means while the hydraulic pressure is detected by the hydraulic pressure detecting means. The diagnosing means diagnoses the cushioning device such that a range of the detected blank-holding force is in the optimum range if the detected blank-holding force and the detected hydraulic pressure substantially satisfy the predetermined formula. The apparatus may comprise means for indicating whether the detected blank-holding force is in the optimum range, and/or means for indicating the optimum range of the blank-holding force. Thus, like the diagnosing method according to the fifth aspect of the invention, the diagnosing apparatus according to the present sixth aspect of the invention permits each and accurate diagnosis of the cushioning device on the optimum range of the blank-holding force. The diagnosis may be effected while the initial values of the blank-holding force and the hydraulic pressure are changed. Further, the diagnosis may be performed to find out a range of movement of the press slide corresponding to the optimum range of the blank-holding force, by detecting the blank-holding force and hydraulic pressure while the press slide is reciprocated. The diagnosis may also be effected to check if the blank-holding force established during a pressing operation is in the optimum range or not.

BRIEF DESCRIPTION OF THE DRAWINGS

The above and optional objects, features and advantages of the present invention will be better understood by reading the following detailed description of presently preferred embodiments of this invention, when considered in connection with the accompanying drawings, in which.

DETAILED DESCRIPTION OF THE PREFERRED EMBODIMENTS

Figure 3:
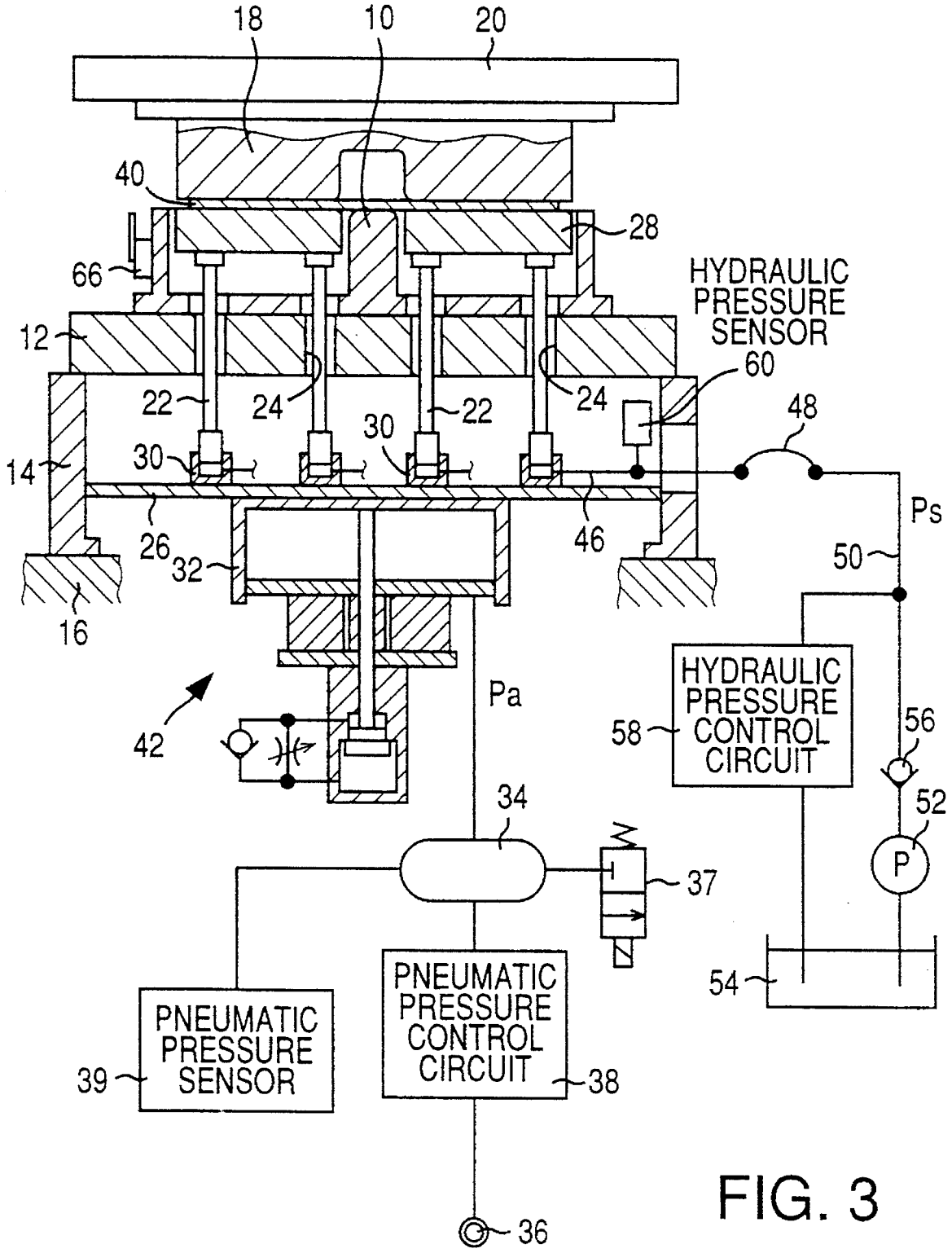
FIG. 3 is a schematic view showing a press equipped with a cushioning device incorporating a diagnosing apparatus constructed according to one embodiment of this invention to diagnose the cushioning device.

Referring first to FIG. 3, there is shown a part of a press in which a lower die in the form of a punch 10 is mounted on a bolster 12 disposed on a carrier 14 resting on a machine base 16, while an upper die 18 is carried by a press slide 20 which is vertically reciprocated by a drive mechanism well known in the art. The bolster 12 has a multiplicity of through-holes 24 through which respective cushion pins 22 extend in the direction of reciprocation of the press slide 20. The cushion pins 22 are supported at their lower ends by a cushion platen 26 disposed below the bolster 12.

The cushion pins 22 are provided to support, at their upper ends, a pressure member in the form of a pressure ring 28 which is disposed so as to surround the working portion of the punch 10. The number of the cushion pins 22 and their positions relative to the pressure ring 28 are determined as needed depending upon the size and configuration of the pressure ring 28. The cushion platen 26 is provided with a multiplicity of balancing hydraulic cylinders 30 disposed thereon in alignment with the respective through-holes 24 formed through the bolster 12. The hydraulic cylinder 30 have housings secured to the upper surface of the cushion platen 26, and pistons which are held in abutting contact with the lower end faces of the respective cushion pins 22. As indicated above, the punch 10, die 18 and pressure ring 28 serve as the lower die, upper die and pressure member, respectively, and cooperate to provide a die set.

The cushion platen 26 is disposed within the press carrier 14 and supported by a cushioning pneumatic cylinder 32, such that the platen 26 is movable in the direction of reciprocation of the press slide 20, and biased by the pneumatic cylinder 32 in the upward direction. The pneumatic cylinder 32 has an air chamber communicating with an air tank 34 which stores compressed air having a pneumatic pressure Pa supplied from an air pressure source 36 via a pneumatic pressure control circuit 38.

To the air tank 34, there are connected a shut-off valve 37 and a pneumatic pressure sensor 39. The pneumatic pressure Pa in the air tank 34 and pneumatic cylinder 32 is adjusted by the pressure control circuit 38 and shut-off valve 37, depending upon a desired blank-holding force to be applied to the pressure ring 28. Described in detail, a blank 40 in the form of a metal strip to be drawn into an intended article is placed on the pressure ring 28 before a pressing or drawing operation on the blank 40 is started with a downward movement of the press slide 20 with the upper die 18. As the slide 20 is moved down to a given point, the upper die 18 forces an outer portion of the blank 40 against the pressure ring 28, whereby the blank 40 is held in place prior to a drawing action on the blank 40 between the upper and lower dies 18, 10. As a result, the pneumatic cylinder 32 is pressed down via the pressure ring 28, cushion pins 22, hydraulic cylinders 30 and cushion platen 26, whereby a reaction force corresponding to the pneumatic pressure Pa of the cylinder 32 acts on the pressure ring 28 as the blank-holding force or cushioning force, as well known in the art.

In the present embodiment, the pneumatic cylinder 32, air tank 34, air pressure source 36 and pneumatic pressure control circuit 38 constitute force generating means 42 for generating the blank-holding force to be applied to the pressure ring 28 through the platen 26, hydraulic cylinders 30 and cushion pins 22. This force generating means 42 cooperates with the hydraulic cylinders 30, cushion platen 26 and cushion pins 22 to provide a mechanical portion of a cushioning device 44 for applying the blank-holding force to the pressure ring 28 to hold the blank 40.

The fluid chambers of the hydraulic cylinders 30 communicate with each other by a manifold 46, which is connected to a fluid passage 50 through a flexible tube 48. The fluid passage 50 is connected to a pneumatically operated hydraulic pump 52, which operates to pressurize a working fluid sucked up from an oil tank 54. The pressurized fluid is supplied from the pump 52 to the fluid passage 50 through a check valve 56. To the fluid passage 50, there is connected a hydraulic pressure control circuit 58 provided with a pressure relief valve. The hydraulic pressure control circuit 58 and the pump 52 cooperate to adjust a hydraulic pressure Ps in the passage 50 and hydraulic cylinders 30. The hydraulic pressure Ps is detected by a hydraulic pressure sensor 60 connected to the manifold 46.

Figure 4:
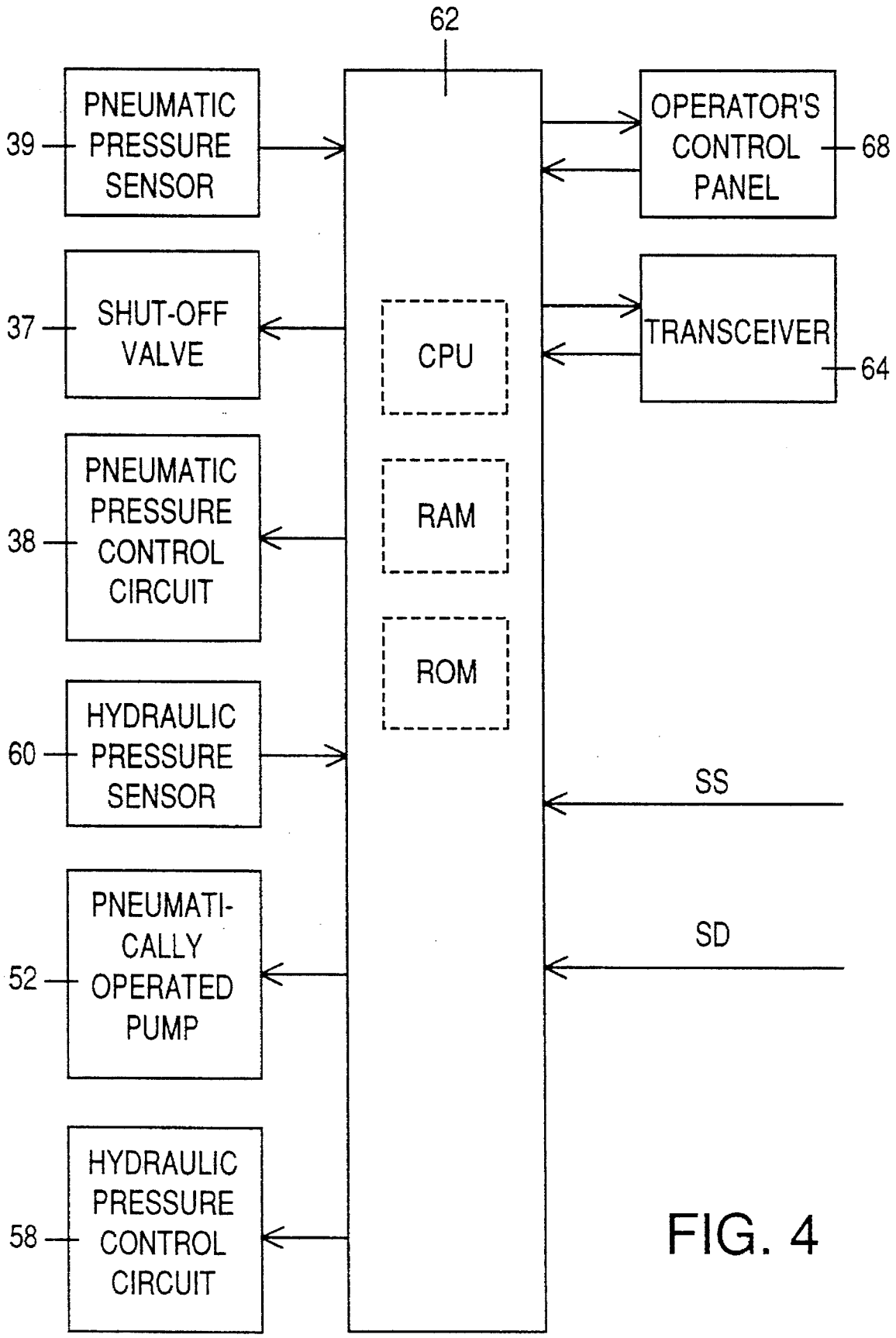
FIG. 4 is a block diagram illustrating an arrangement of a control system of the diagnosing apparatus provided on the press of FIG. 3.
Figure 5A:
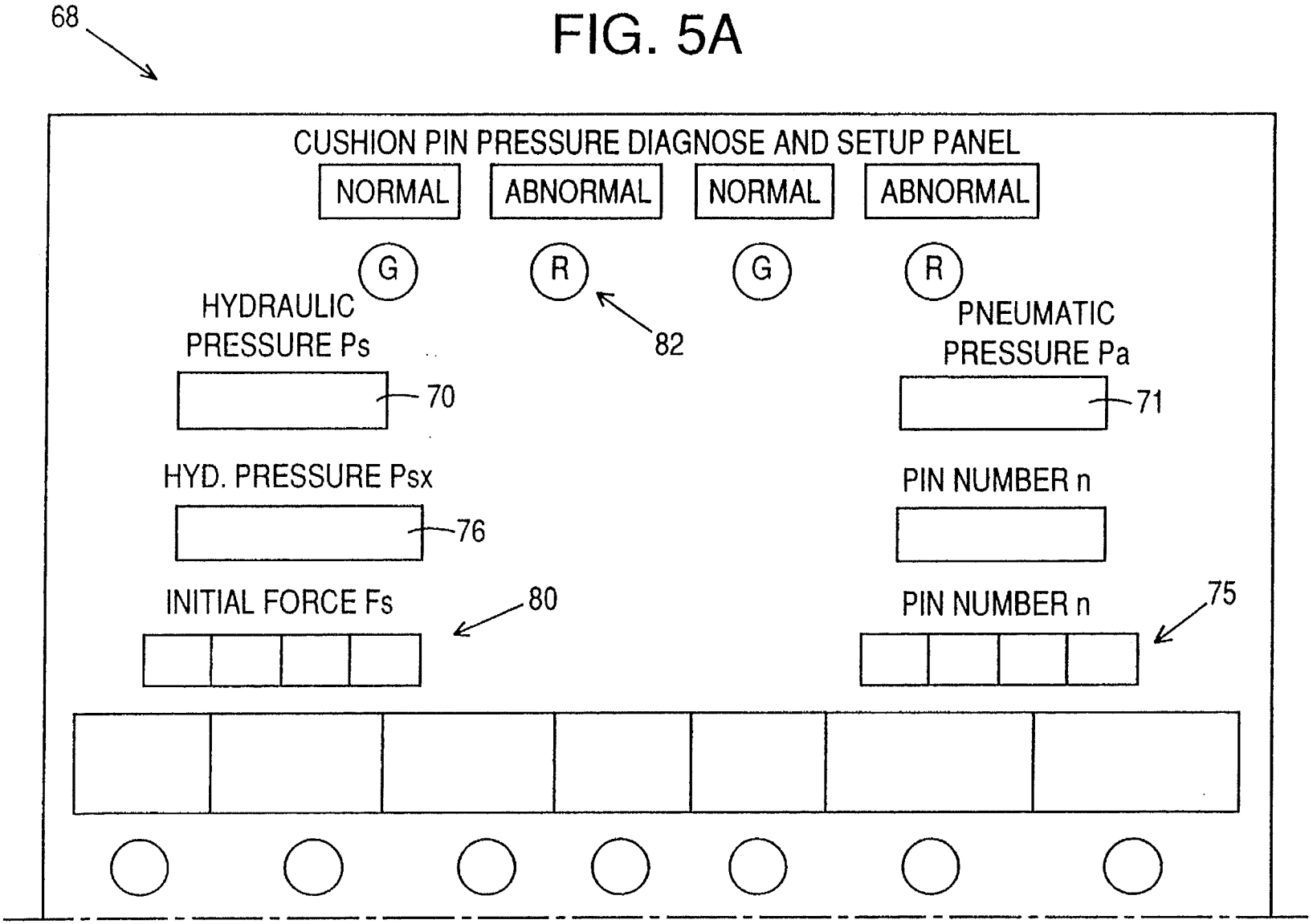
FIGS. 5A and 5B are views illustrating an operator's control panel indicated in FIG. 4.
Figure 5B:
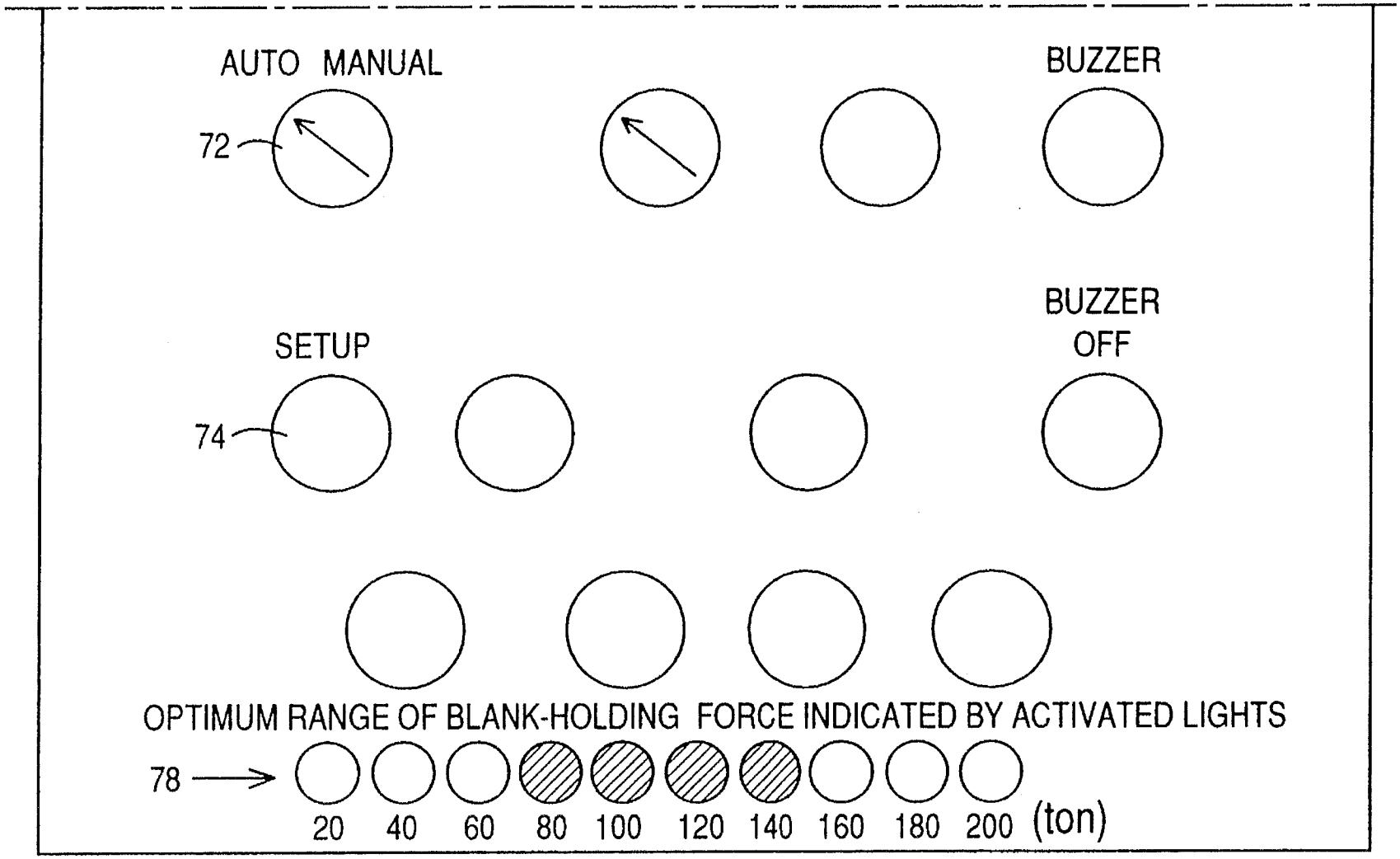

The hydraulic pressure Ps and pneumatic pressure Pa indicated above are controlled by a control unit 62 illustrated in FIG. 4. The control unit 62 receives output signals of the pneumatic pressure sensor 39 and hydraulic pressure sensor 60 indicative of the pneumatic and hydraulic pressures Pa, Ps, through amplifiers and A/D converters. The control unit 62 incorporates a microcomputer including a central processing unit (CPU), a random-access memory (RAM) and a read-only memory (ROM). The microcomputer operates according to various control programs stored in the ROM, for adjusting the pneumatic and hydraulic pressures Pa, Ps and performing a diagnosis on the optimum range of the blank-holding force within which the blank-holding force can be substantially evenly distributed on all of the cushion pins 22 by the hydraulic cylinders 30. The control unit 60 is also connected to an operator's control panel 68, and is adapted to receive a TEST OPERATION signal SS and a LOWER STROKE END signal SD. The TEST OPERATION signal SS is generated when a TEST OPERATION switch provided on the press is activated to perform a test operation on the press. The LOWER STROKE END signal SD is generated when the press slide 20 is located substantially at its lower stroke end (located at the lower stroke end or a point slightly above the lower stroke end). The operator's control panel 68 has various indicators and switches as shown in FIGS. 5A and 5B. The panel 68 includes an indicator 70 for indicating the hydraulic pressure Ps and an indicator 71 for indicating the pneumatic pressure Pa.

The control unit 62 stores in the RAM machine information such as a weight Wa of the cushion platen 26, an average weight Wp of the cushion pins 22, a pressure-receiving area Aa of the pneumatic cylinder 32 and a pressure-receiving area As of the hydraulic cylinders 30. Further, the control unit 62 is adapted to receive die set information from an ID card 66 through a transceiver 64. The ID card 66 is attached to the punch 10, as shown in FIG. 3. The die set information includes a weight Wr of the pressure ring 28, and the number n of the cushion pins 22. The ID card 66 has a function of storing the die set information on the specific die set, which includes the punch 10 to which the ID card 66 is attached. The ID card 66 also has a function of transmitting the die set information to the transceiver 64, in response to a signal from the transceiver 64 which requests the transmission of the die set information. The weight Wa of the cushion platen 26, pressure-receiving area Aa of the pneumatic cylinder 32, etc. indicated above are values which reflect influences of a sliding resistance given to the platen 26, an air leakage of the cylinder 32, and other factors affecting the operation of the cushioning device 44. For instance, the machine information may be obtained by experiments using a load measuring apparatus as disclosed in co-pending Application No. 08/043,864 (corresponding to laid-open Publication No. 5-285555 of unexamined Japanese Patent Application).

Referring next to the flow charts of FIG. 6A and 6B, there will be described a diagnostic routine executed by the control unit 62 for diagnosing the cushioning device 44 on the range of the blank-holding force in which the blank-holding force can be substantially evenly distributed on the cushion pins 22 or pressure ring 28. The diagnostic routine is initiated with step S1 to determine whether an AUTO-MANUAL selector switch 72 on the operator's control panel 62 is currently placed in an AUTO position for effecting an automatic diagnosis of the cushioning device 44. Step S1 is repeated until an affirmative decision (YES) is obtained. With the affirmative decision obtained in step S1, step S2 is implemented to determine whether a SETUP pushbutton 74 also provided on the operator's control panel 68 has been turned ON. When the SETUP pushbutton 74 is turned on with the AUTO-MANUAL selector switch 72 placed in the AUTO position, the control flow goes to step S3 to set an initial blank-holding force $Fs_n$ (n=1 through 10) at the moment when the upper die 18 has come into abutting contact with the blank 40 on the pressure ring 28, namely, just before the volume of the pneumatic cylinder 32 begins to decrease. Initially, the initial blank-holding force $Fs_n$ is set at 200 tons in step S2. Each time step S2 is repeated, the initial blank-holding force $Fs_n$ is decremented by an amount of 20 tons. The force Fs1 is equal to 200 tons, while the force Fs10 is equal to 20 tons. The force values Fs1 through Fs10 are stored in the ROM of the control unit 62. It is noted that 1 ton is equal to about 0.1 kN (kilo Newton). Before the diagnostic routine of FIGS. 6A and 6B is commenced, the hydraulic pressure Ps of the hydraulic cylinders 30 prior to a pressing cycle has been adjusted to a suitable initial level Pso by means of the pump 52 and hydraulic pressure control circuit 58.

Then, the control flow goes to step S4 to activate the pneumatic pressure control circuit 38 and shut-off valve 37, for adjusting the pneumatic pressure Pa of the pneumatic cylinder 32 according to the following equation (7), so that the initial blank-holding force Fs is adjusted to the value $Fs_n$ set in step S3.

$$Pa=(Fs_n+Wa+n\cdot Wp+Wr)/Aa \quad (7)$$

Figure 6A:
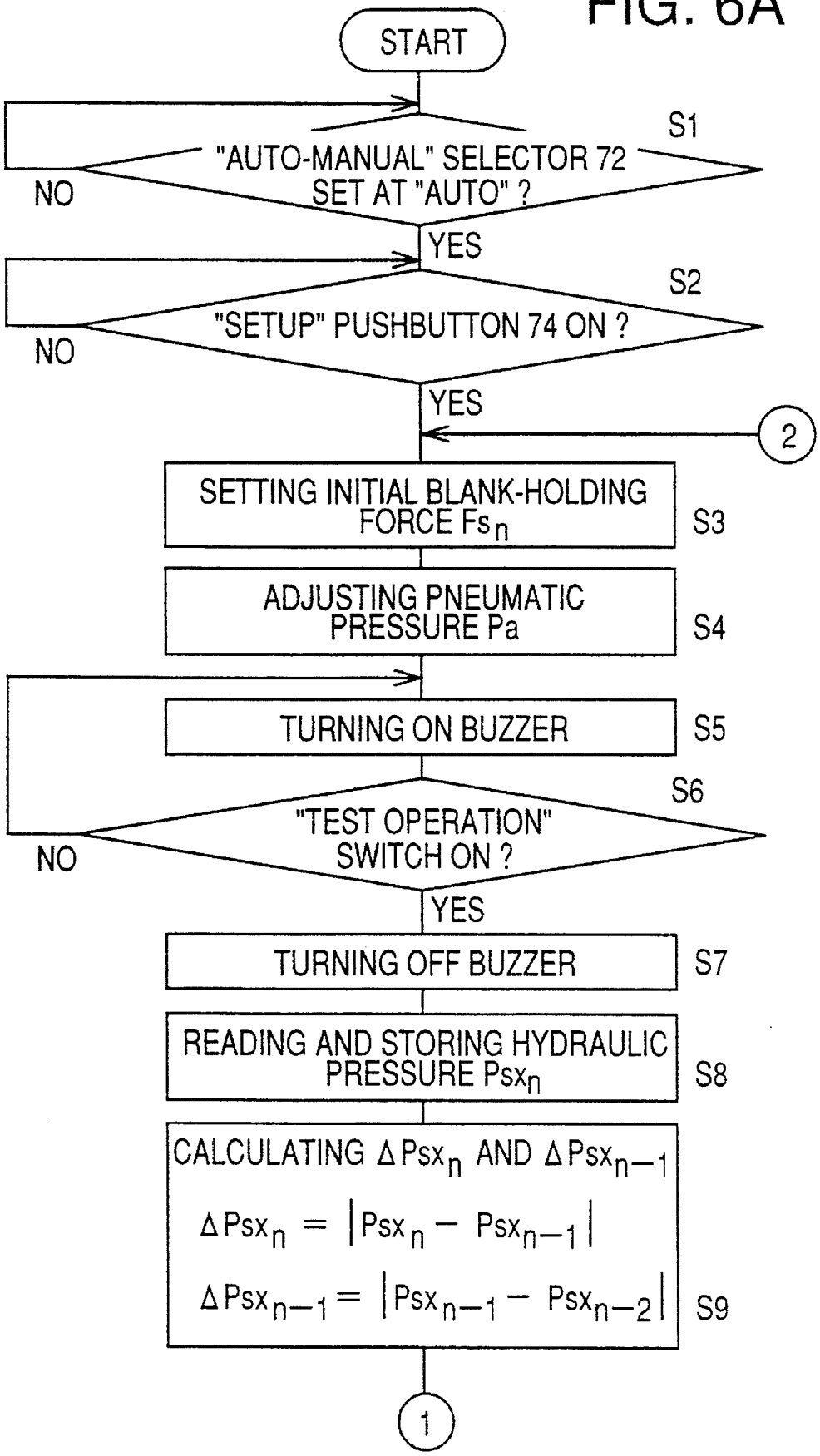
FIG. 6A and 6B are flow charts illustrating a diagnostic routine executed by the diagnosing apparatus to diagnose the cushioning apparatus of FIG. 3.
Figure 6B:
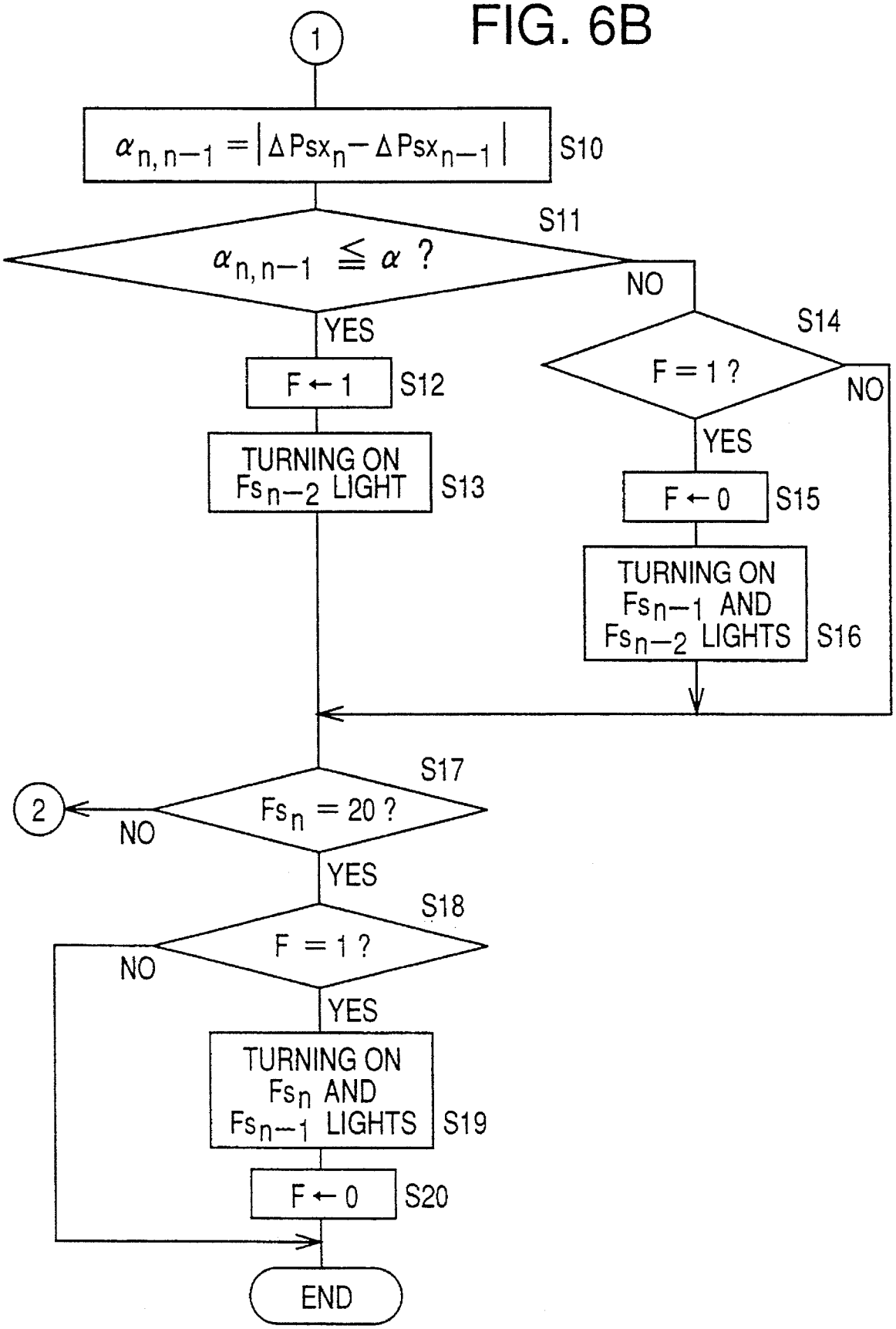

When the routine of FIGS. 6A and 6B is executed for the first time, the pneumatic pressure Pa is adjusted so that the blank-holding force Fs is adjusted to 200 tons. The adjustment of the pneumatic pressure Pa in step S4 is effected on the basis of the output signal of the pneumatic pressure sensor 39. The weight values Wa and Wp and the pressure-receiving area Aa in the equation (7) are stored as the machine information in the RAM of the control unit 62, while the weight Wr and the number n of the cushion pins 22 are received as the die set information from the ID card 66 through the transceiver 64. When it is desired to change the number n of the cushion pins 22 in view of a result of a test operation on the press, the number n used in the equation (7) is changed through PIN NUMBER setting dials 75 provided on the operator's control panel 68. If the weight Wr of the pressure ring 28 is considerably smaller than the other load values used in the equation, this weight value Wr may be omitted.

Figure 7:
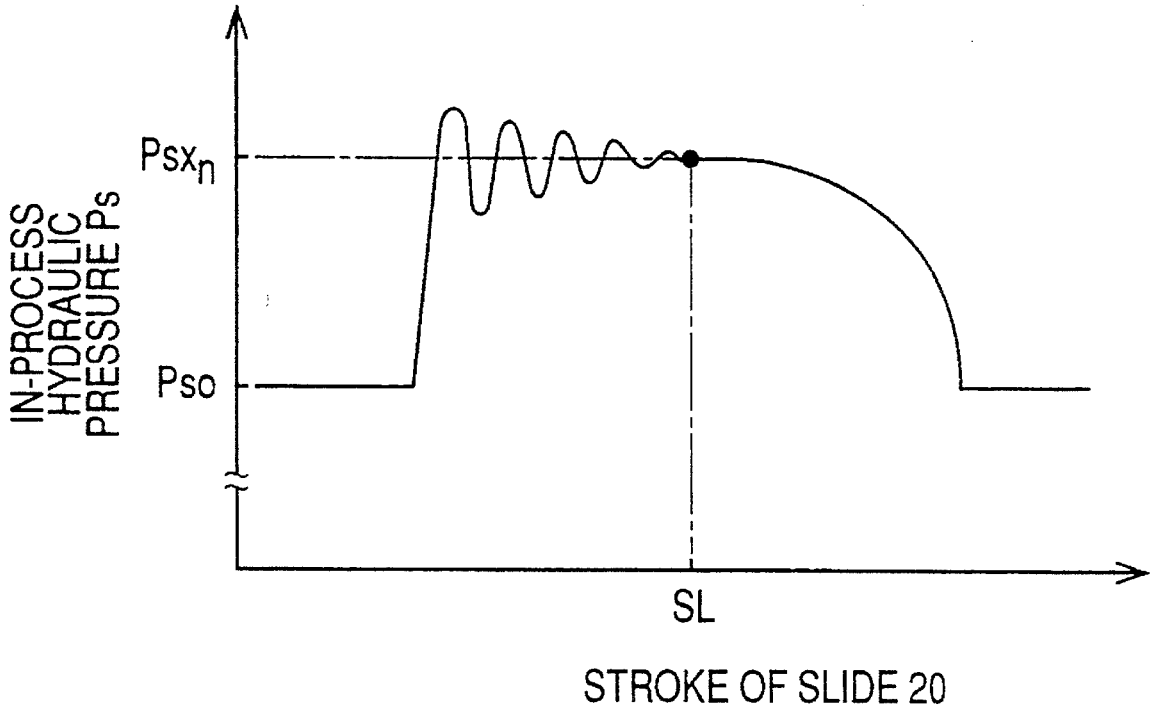
FIG. 7 is a graph explaining a point at which the detected in-process hydraulic pressure $Psx_n$ is read in step S8 of the flow chart of FIG. 6A.

When the adjustment of the pneumatic pressure Pa in step S4 is completed, step S5 is implemented to activate a buzzer in a predetermined pattern of sound generation. The activation of the buzzer indicates that the press is ready to start a test operation. The control flow then goes to step S6 to determine whether the TEST OPERATION switch on the press has been activated. When the TEST OPERATION switch is activated by the operator who has recognized the activation of the buzzer, the buzzer is turned off in step S7, in response to the TEST OPERATION signal SS received from the TEST OPERATION switch. Step S7 is followed by step S8 to detect an in-process hydraulic pressure $Psx_n$ generated in the hydraulic cylinders 30 during a pressing cycle initiated by the activation of the TEST OPERATION switch in step S6. The pressure $Psx_n$ is detected by the hydraulic sensor 60 and stored in the RAM of the control unit 62, and is indicated on the indicator 76 on the operator's control panel 68. In this respect, it is noted that the in-process hydraulic pressure Ps during a pressing cycle fluctuates or vibrates as indicated in FIG. 7, due to abutting contact of the upper die 18 with the blank 40 and pressure ring 28. In the present embodiment, the in-process hydraulic pressure Ps is determined on the basis of the output signal of the hydraulic sensor 60 when the press slide 10 is located at or near the lower stroke end SL, that is, when the LOWER STROKE END signal SD (described above with respect to the control panel 68) is generated. The in-process hydraulic pressure Ps at this time is stored as the hydraulic pressure value $Psx_n$. However, the hydraulic pressure Ps at any other point of time during the pressing cycle may be used as the pressure value $Psx_n$. For example, the highest or lowest value or average value of the pressure Ps during the pressing cycle may be used as $Psx_n$. To avoid the vibration of the hydraulic pressure Ps, the press slide 20 may be lowered in an inching mode, namely, moved down intermittently by a given incremental distance.

Step S9 is then implemented to calculate a value $\Delta Psx_n$ and a value $\Delta Psx_{n-1}$. The value $\Delta Psx_n$ is equal to $|Psx_n-Psx_{n-1}|$, while the value $\Delta Psx_{n-1}$ is equal to $|Psx_{n-1}-Psx_{n-2}|$, where n represents the ordinal number of the test operation cycle. Thus, the values $\Delta Psx_n$ and $\Delta Psxn_{n-1}$ are amounts of change of the in-process hydraulic pressure Psx between two successive pressing cycles. Step S9 is followed by step S10 to calculate a difference $\alpha_{n.n-1}=|\Delta Psx_n-\Delta Psx_{n-1}|$. Since the initial blank-holding force $Fs_n$ to be set in step S3 is decremented by a predetermined amount of 20 tons, the amounts of change $\Delta Psx_n$ and $\Delta Psx_{n-1}$ correspond to rates of change of the hydraulic pressure Psx when the initial blank-holding force Fs is reduced by 20 tons, and the difference $\alpha_{n.n-1}$ represents a difference between those rates of change. Step S11 is then implemented to determine whether the difference $\alpha_{n.n-1}$ is equal to or smaller than a predetermined tolerance value $\alpha$. The comparison of the difference $\alpha_{n.n-1}$ with this value $\alpha$ is effected to determine whether the two amounts of change $\Delta Psx_n$ and $\Delta Psx_{n-1}$ are substantially equal to each other, that is, whether the in-process hydraulic pressure Psx is lowered at a substantially constant rate as the preset initial blank-holding force $Fs_n$ is decremented. The tolerance value $\alpha$ is determined in view of the possible variation in the in-process hydraulic pressure $Psx_n$, detection error of the pressure $Psx_n$ and adjustment error of the initial pneumatic pressure Pa. The value α may be a predetermined value, or may be calculated according to an equation $\alpha=2000/n\cdot As$ (kgf/cm$^2$), as a function of the number n of the hydraulic cylinders 30 (cushion pins 22) and the pressure-receiving area As of the cylinders 30, so that the total force corresponding to all the hydraulic cylinders 30 is 2 tons. If an affirmative decision (YES) is obtained in step S11, step S12 is implemented to set a flag F to "1". Step S12 is followed by step S13 to turn on one of ten indicator lights 78 on the operator's control panel 68, which one light 78 corresponds to the initial blank-holding force $Fs_{n-2}$ set in the cycle n-2 preceding the last cycle n-1. As indicated in FIG. 5B, the ten indicator lights 78 correspond to ten blank-holding force values 20 tons through 200 tons in increments of 20 tons. If a negative decision (NO) is obtained in step S11, step S14 is implemented to determine whether the flag F is set at "1". If the flag F is currently set at "1", step S15 is implemented to reset the flag F to "0", and step S16 is then implemented to turn on the two indicator lights 78 corresponding to the force values $Fs_{n-1}$ and $Fs_{n-2}$.

Steps S13 and S16 are followed by step S17. This step S17 is also implemented if a negative decision (NO) is obtained in step S14. Step S17 is performed to determine whether the initial blank-holding force $Fs_n$ currently set (in step S3 of the present cycle n) is the lowest value of 20 tons. In other words, step S17 is implemented to determine whether the diagnostic routine of FIGS. 6A and 6B has been repeated ten times (including the present cycle n) until the preset initial blank-holding force Fsn is lowered to the lowest value 20 tons. If a negative decision (NO) is obtained in step S17, and the control flow goes back to step S3, whereby steps S3 through S17 are repeatedly implemented until the force Fsn is lowered to 20 tons.

It is noted that steps S9 through S16 are not implemented in the first and second cycles of execution of the diagnostic routine in which the initial blank-holding force Fsn is set at 200 tons and 180 tons, respectively. In these first two cycles, step S8 is followed by step S17.

Figure 8:
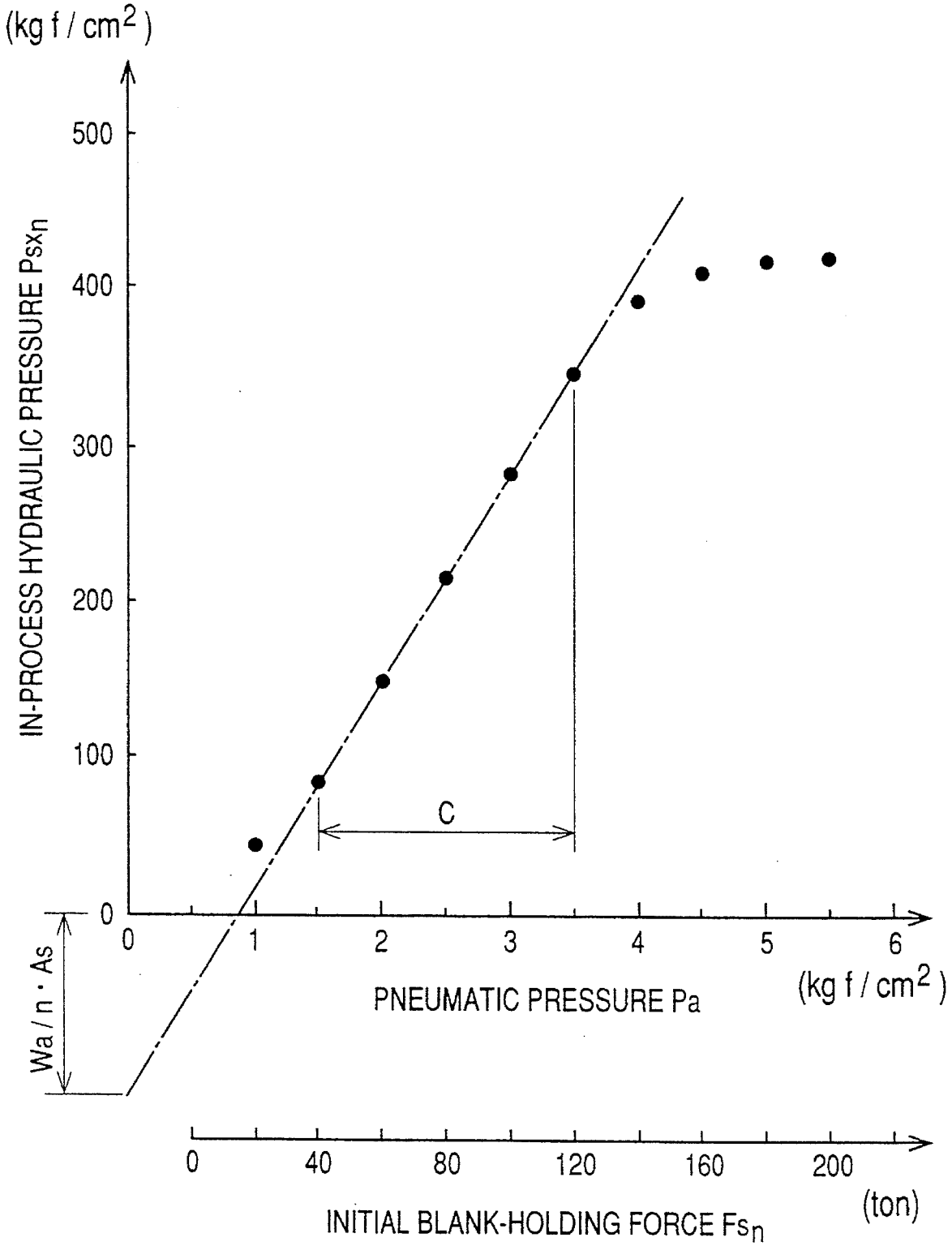
FIG. 8 is a graph indicating an example of a and the blank-holding force $Fs_n$ when the diagnostic relationship between the in-process hydraulic pressure $Psx_n$ operation is performed according to the diagnostic routine of FIGS. 6A and 6B.

The graph of FIG. 8 shows an example of a relationship between the initial blank-holding force $Fs_n$ set in step S3 and the in-process hydraulic pressure $Psx_n$ detected and stored in step S8, which relationship was obtained by repeated execution of step S13 and the following steps. It will be understood from the graph that the rate of change of the in-process hydraulic pressure $Psx_n$ is substantially constant over a range C from 120 tons ($Fs_5$) to 40 tons ($Fs_9$). That is, the amount of change $\Delta Psx_n$ of the hydraulic pressure $Psx_n$ between the two successive cycles is substantially constant over the range C. Described in detail, in the seventh cycle with the force $Fs_7$=80 tons, the amounts of change $\Delta Psx_n$ and $\Delta Psx_{n-1}$ are substantially equal to each other, and the difference $\alpha_{n.n-1}$ between these amounts of change is smaller than the tolerance value α, whereby the affirmative decision (YES) is obtained in step S11, so that the indicator light 78 corresponding to the force value $Fs_{n-2}$=Fs5=120 tons is turned on in step S13. In the eighth and ninth cycles with the force values $Fs_8$=60 tons and $Fs_9$=40 tons, the indicator lights 78 corresponding to the force values $Fs_6$=100 tons and $Fs_7$=80 tons are turned on in step S13, since the difference $\alpha_{n.n-1}$ is smaller than the tolerance value α. In the tenth or last cycle with the force $Fs_{10}$=20 tons, the amount of change $\Delta Psx_{10}$ is reduced, and the negative decision (NO) is obtained in step S11, whereby step S14 is implemented. Since the flag F was set to "1" in the ninth cycle, the affirmative decision (YES) is obtained in step S14, and step S16 is implemented to turn on the indicator lights 78 corresponding to the force values $Fs_9$=40 tons and $Fs_8$=60 tons. Thus, the five indicator lights 78 are turned on during the test operation, indicating a range from 120 tons to 40 tons, as shown in FIG. 5B wherein hatched ones of the ten circles at the bottom of the view indicate the activated lights 78. The row of the indicator lights 78 serves as means for indicating the range of the initial blank-holding force $Fs_n$ within which the blank-holding force is substantially evenly distributed on the cushion pins 22 or over the entire surface area of the pressure ring 28.

It will be understood that the range of the initial blank-holding force Fsn indicated by the activated indicator lights 78 is the optimum range C in which the amount of change ΔPsx of the in-process hydraulic pressure Psx with a change in the blank-holding force Fs is substantially constant. In this optimum range C of the initial blank-holding force $Fs_n$, the pistons of all hydraulic cylinders 30 linked with the cushion pins 22 are placed in their neutral positions between their upper and lower stroke ends, whereby the blank-holding force Fs can be substantially evenly distributed on the pressure ring 28.

Thus, the optimum range C of the initial blank-holding force $Fs_n$ is detected according to the diagnostic routine of FIGS. 6A and 6B executed during a test operation. The presence of this optimum range C of the force $Fs_n$ means the presence of an optimum range of the pneumatic pressure Pa of the pneumatic cylinder 32, and an optimum range of the in-process hydraulic pressure $Psx_n$ of the hydraulic cylinders 30.

The range of the initial blank-holding force $Fs_n$ to be set in step S3, and the decrement amount of this force $Fs_n$ are determined depending on the number n, pressure-receiving area As and piston stroke of the hydraulic cylinders 30, and the desired range in which the blank-holding force Fs can be changed, so that the optimum range C indicated above can be found irrespective of the desired blank-holding force for a specific pressing operation, and the number n of the cushion pins 22 used. One-dot chain line in the graph of FIG. 8 corresponds to the above equation (5), and the rate of change of the hydraulic pressure $Psx_n$ with the pneumatic pressure Pa is represented by Aa/n·As.

The optimum range C of the initial blank-holding force $Fs_n$ cannot be found or two or more optimum ranges C may be found as a result of execution of the diagnostic routine of FIGS. 6A and 6B, if the pistons of some of the hydraulic cylinders 30 are bottomed or located at their lower stroke ends while the pistons of the other hydraulic cylinders 30 are placed at their neutral positions. This phenomenon may take place due to an excessively large variation in the length of the cushion pins 22 or an excessively small operating stroke of the cylinders 30, for instance. If this phenomenon occurs, it means some abnormality or trouble with the cushioning device 44, which may be detected by observing the operating states of the indicator lights 78 on the operator's control panel 68. In this respect, it is possible to provide a suitable indicator to inform the operator of the press of such abnormality if none of the indicator lights 78 are turned on (namely, if no optimum range C is detected) or if there is at least one de-activated indicator light 78 between the activated indicator lights 78 (namely, if the indicator lights 78 indicate two or more optimum ranges C) upon completion of the diagnostic routine.

When the AUTO-MANUAL selector switch 72 is turned to the MANUAL position, the initial blank-holding force Fs can be changed or set through INITIAL FORCE setting dials 80 provided on the control panel 68. The hydraulic pressure Psx generated during a pressing operation with the set blank-holding force Fs is indicated on the indicator 76 also provided on the control panel 68. Thus, the control panel 68 permits the operator to manually check a change of the in-process hydraulic pressure Psx by changing the initial blank-holding force Fs in relatively small increments, for thereby finding out the optimum range C in the manual mode with the selector switch 72 set at MANUAL.

Referring back to the flow chart of FIG. 6B, step S18 is implemented if an affirmative decision (YES) is obtained in step S17. Step S18 checks if the flag F is set at "1". If the flag F is set at "0", the diagnostic routine is ended. If the flag F is set at "1", step S19 is implemented to turn on the indicator lights 78 corresponding to the force values $Fs_n$ and $Fs_{n-1}$. In the example described above by reference to the graph of FIG. 8, the indicator lights 78 corresponding to the force values $Fs_{10}$=20 tons and $Fs_9$=40 tons are turned on in step S19. Then, step S20 is implemented to rest the flag F to "0". Steps 18–S20 are provided for the last cycle with the force value $Fs_{10}$= tons, and steps S19 and S20 are implemented to turn on the indicator lights 78 corresponding to $Fs_{10}$ and $Fs_9$ if the affirmative decision (YES) is obtained in step S12 in any preceding cycle.

As described above, the cushioning device 44 is diagnosed on the optimum range of the initial blank-holding force Fsn within which the blank-holding force Fs can be substantially evenly distributed on the cushion pins 22 (on the pressure ring 28). This diagnostic routine may be used when a die set is prepared. For example, the diagnostic routine is executed to find out the optimum range C of the initial blank-holding force $Fs_n$, for the purpose of detecting the optimum blank-holding force Fs by changing the initial blank-holding force $Fs_n$ within the optimum range C found. The optimum range C found can also be used when the blank-holding force Fs is adjusted during a production run of the press, so as to meet the particular characteristics of the blank 40. If the optimum blank-holding force Fs for assuring sufficiently high quality of the article produced from the blank 40 cannot be actually found within the optimum range c found according to the diagnostic routine, the cushioning device 44 may be adjusted by changing the number n of the cushion pins 22 (number of the hydraulic cylinders 30 linked with the cushion pins), or changing the initial hydraulic pressure Pso, so that the optimum initial blank-holding force Fso is reduced to a level at which the in-process blank-holding force Fs can be substantially evenly distributed on the pressure ring 28.

Figure 9:
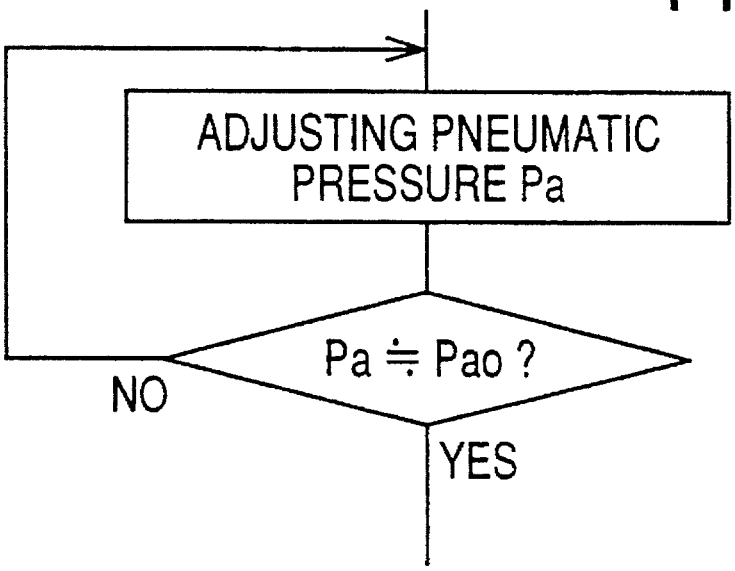
FIG. 9 is a fragmentary flow chart illustrating steps for controlling an initial pneumatic pressure P in the cushioning device of FIG. 3 during a pressing operation.

With the optimum initial blank-holding force Fso determined within the optimum range C found as described above, the shut-off valve 37 and the pneumatic pressure control circuit 38 are operated to regulate the pneumatic pressure Pa to the optimum level Pao which corresponds to the optimum initial blank-holding force Fso. This adjustment is effected according to a routine as illustrated in FIG. 9, in which the pneumatic pressure Pa is adjusted until it becomes substantially equal to the optimum level Pao. According to the adjustment of the pneumatic pressure Pa, the pistons of all the hydraulic cylinders 30 linked with the cushion pins 22 are held at their neutral position during an actual pressing or drawing operation, so that the surface pressure of the pressure ring 28 with respect to the blank 40 is made substantially uniform over the entire area of the pressure ring 28.

Figure 10:
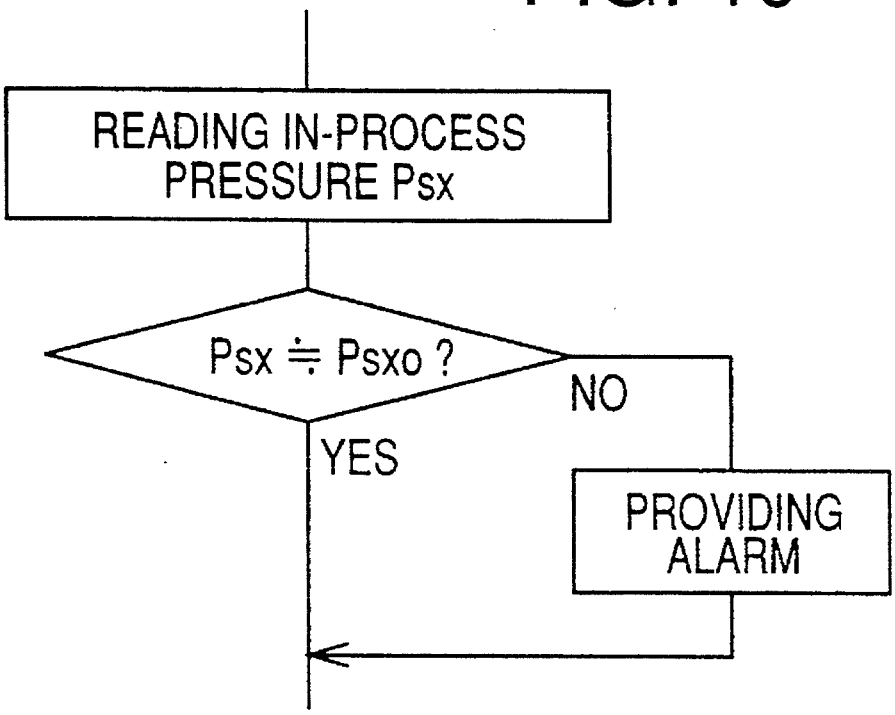
FIG. 10 is a fragmentary flow chart illustrating steps for monitoring the in-process hydraulic pressure Psx in the cushioning device of FIG. 3 during a pressing operation.

Further, an optimum in-process hydraulic pressure Psxo corresponding to the optimum initial blank-holding force Fso can be obtained on the basis of the relationship as indicated in the graph of FIG. 8 or according to the above equation (5). This optimum in-process hydraulic pressure Psxo may be used to check if the in-process hydraulic pressure Psx detected during an actual pressing operation coincides with the optimum level Psxo, and to activate an alarm light 82 on the operator's control panel 68, if the actually detected hydraulic pressure value Psx is not substantially equal to the optimum value Psxo, according to a suitable routine as illustrated in the flow chart of FIG. 10. The activation of the alarm light 82 to provide an alarm indicating the operator of some abnormality with the press may be replaced by other means such as activation of a buzzer in a suitable pattern of sound generation. The blank-holding force Fs can be calculated on the basis of the actual hydraulic pressure Psx and according to the above equation (2). The actual blank-holding force Fs can be checked for adequacy during a pressing operation, based on the value calculated according to the equation.

As described above, the control unit 62 of the present embodiment of the invention is adapted to perform a diagnostic routine for detecting and storing the in-process hydraulic pressure values $Psx_n$ corresponding to the predetermined ten different initial blank-holding force values $Fs_n$, and finding out the optimum range C of the initial blank-holding force $Fs_n$ within which the amount of change $\Delta Psx_n$ of the hydraulic pressure $Psx_n$ is substantially constant. Thus, the diagnostic routine permits easy and accurate determination of the optimum range C in which the blank-holding force Fs can be substantially evenly distributed on the pressure ring 28. Further, the indicator lights 78 permit the operator to find any abnormality associated with the cushioning device 44. By simply operating the AUTO-MANUAL selector switch 72 and depressing the SETUP pushbutton 74 on the operator's control panel 68, the diagnostic routine is automatically executed to detect the in-process hydraulic pressure $Psx_n$, calculate the amounts of change $\Delta Psx_n$, $\Delta Psx_{n-1}$, and activate the indicator lights 78 so as to indicate the optimum range C of the initial blank-holding force $Fs_n$. The present arrangement assures accurate diagnosis of the cushioning device 44 with a minimum of operator's efforts and a minimum of risk of operator's erroneous manipulation of the machine for diagnosis.

It will be understood that steps S23, S4 and S8 implemented by the control unit 62 correspond to a step of detecting the hydraulic pressure $Psx_n$ of the hydraulic cylinders 30, while steps S9–S11, S13, S16 and S19 correspond to a step of diagnosing the cushioning device 44 on the optimum range C of the initial blank-holding force $Fs_n$. It will also be understood that the portion of the control unit 62 assigned to implement steps S3, S4 and S17 cooperates with the shut-off valve 37 and pneumatic pressure control circuit 38 to constitute means for changing the blank-holding force Fs, while the portion of the control unit 62 assigned to implement step S8 cooperates with the hydraulic pressure sensor 60 to constitute means for detecting the hydraulic pressure $Psx_n$. It will also be understood that the portion of the control unit 62 assigned to implement step S9 constitutes means for calculating the rate of change of the hydraulic pressure Psx, while the portion of the control unit 62 assigned to implement steps S9, S10, S11, S13, S16 and S19 constitutes means for diagnosing the cushioning device 44 on the optimum range C of the initial blank-holding force $Fs_n$.

There will be described other embodiments of the present invention. In these embodiments, the same reference numerals as used in the first embodiment will be used to identify the corresponding elements of the press.

Figure 11A:
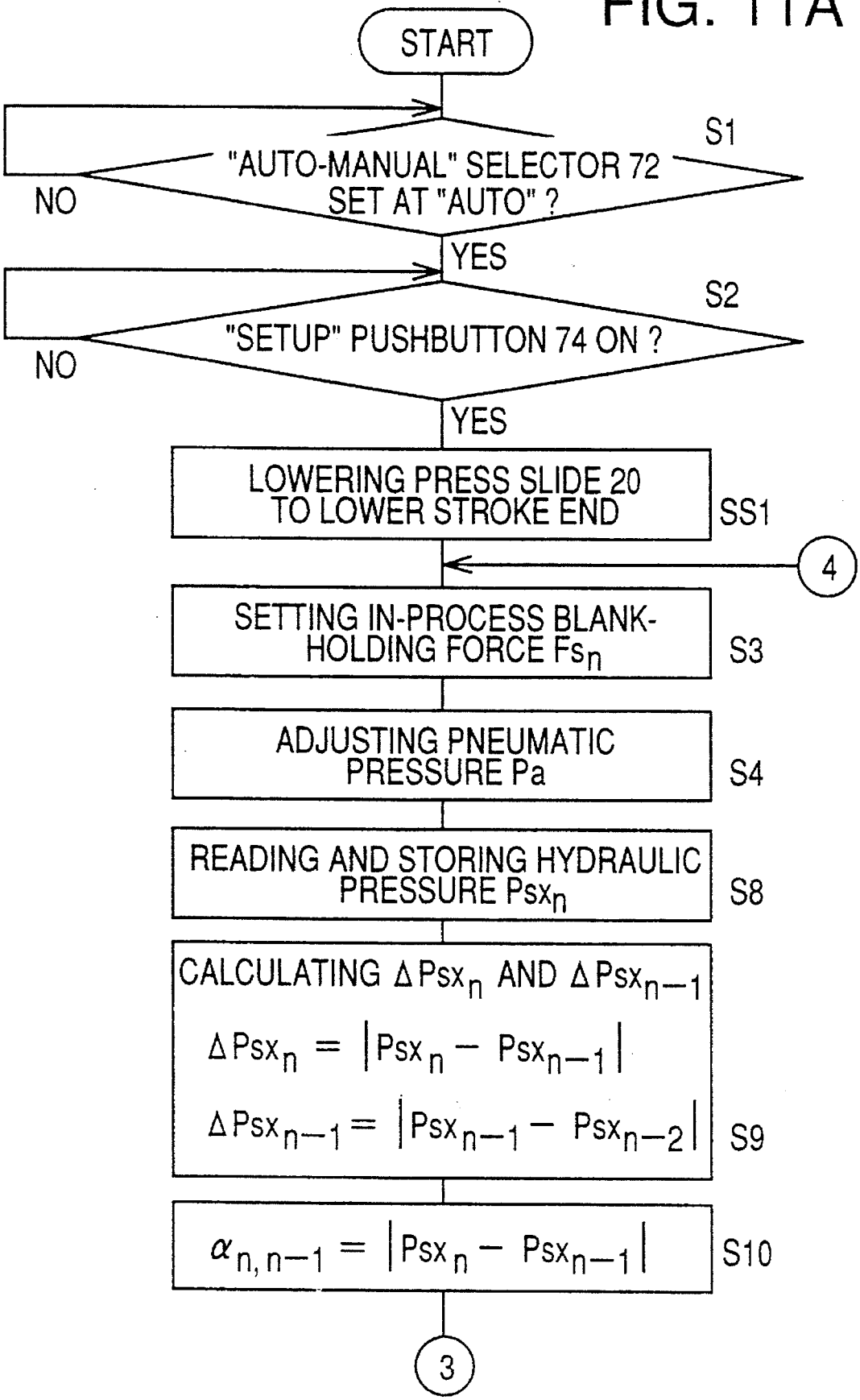
FIGS. 11A and 11B are flow charts illustrating a a diagnostic routine executed by a diagnosing apparatus according to another embodiment of the present invention.
Figure 11B:
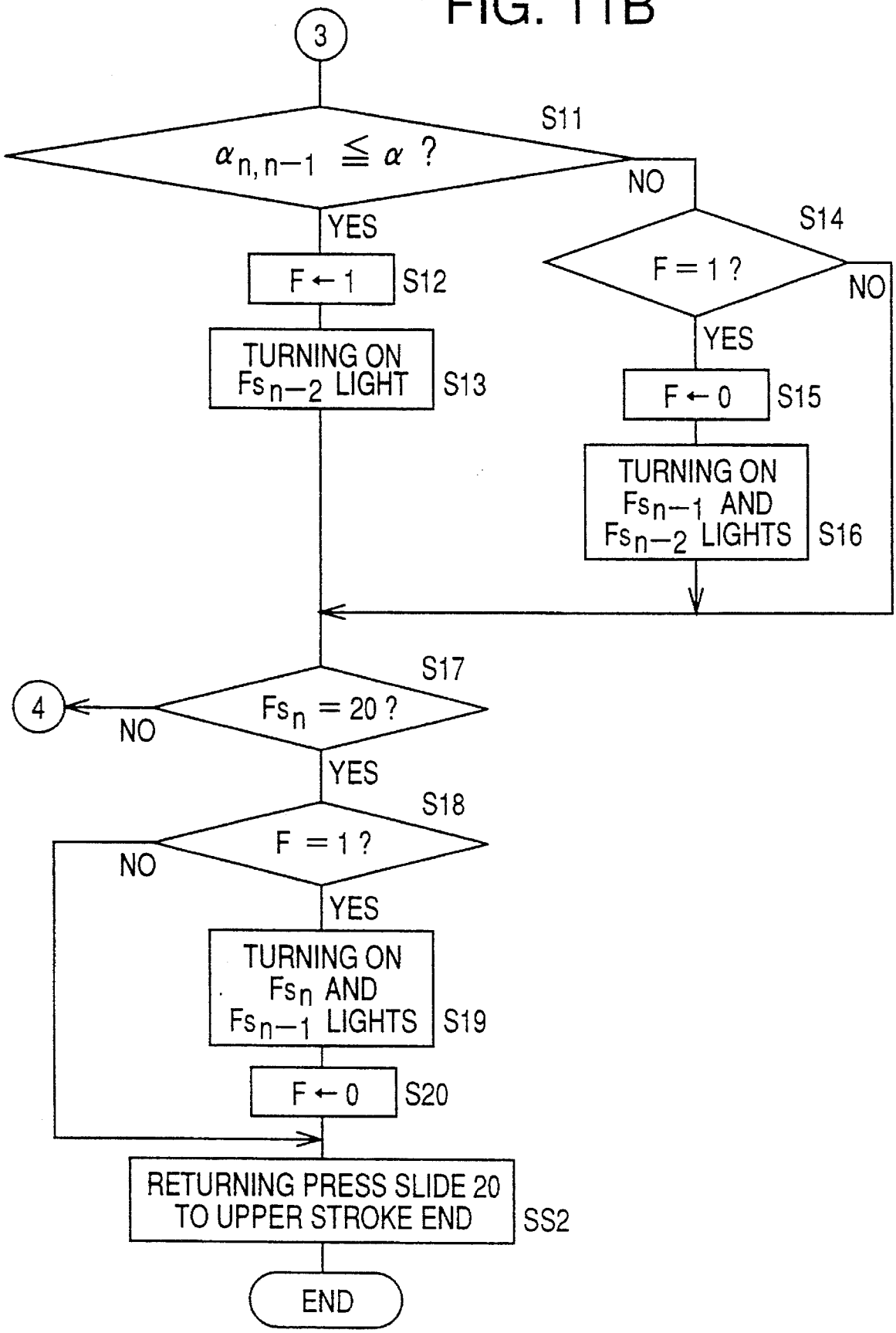

Reference is now made to the flow charts of FIGS. 11A and 11B illustrating the second embodiment, which is different from the first embodiment only in that the diagnosis is effected with the press slide 20 held at its lower stroke end. Described more specifically, if the affirmative decision (YES) is obtained in step S2 with the SETUP pushbutton 74 depressed by the operator, step SS1 is implemented to lower the press slide 20 to its lower stroke end. In the following step S3, the in-process blank-holding force $Fs_n$ (n=1~10) when the press slide 20 is at its lower stroke end is set. The in-process blank-holding force $Fs_n$ is decremented by 20 tons from 200 tons to 20 tons. The in-process force value $Fs_n$ at the lower stroke end of the press slide 20 is greater than the initial force value $Fs_n$ upon abutting contact of the upper die 18 with the blank 40 (described above with respect to the first embodiment), by an amount corresponding the amount of volumetric reduction of the pneumatic cylinder 32 due to the lowering movement of the press slide 20. In this respect, therefore, it is possible to accordingly raise the in-process blank-holding force $Fs_n$ to be set in step S3 in the present second embodiment.

Step S4 is then implemented to adjust the pneumatic pressure Pa as in the first embodiment, and step S8 and the following steps are implemented to detect and store the in-process hydraulic pressure $Psx_n$, calculate the amounts of change $\Delta Psx_n$, $\Delta Psx_{n-1}$, determine whether the difference $\alpha_{n.n-1}$ is equal to or smaller than the tolerance value $\alpha$, and activate the appropriate indicator lights 78, as in the first embodiment. Step S3 and the following steps are repeatedly implemented with the in-process blank-holding force $Fs_n$ being decremented, to eventually diagnose the cushioning device 44 on the optimum range C of the in-process blank-holding force $Fs_n$. Step SS2 is finally implemented to return the press slide 20 to the upper stroke end, and the diagnostic routine is ended. The pneumatic pressure Pa may be adjusted prior to step SS1 so that the initial blank-holding force is about 200 tons. In this case, the pneumatic pressure Pa is lowered to a level corresponding to the in-process blank-holding force $Fs_n$ set in step S3.

In the present second embodiment, the in-process blank-holding force $Fs_n$ when the press slide 20 is at its lower stroke end is diagnosed. The optimum in-process blank-holding force Fs can be established within the optimum range, by adjusting the initial blank-holding force, more precisely, by adjusting the initial pneumatic pressure Pa of the pneumatic cylinder 32, for example, on the basis of the operating stroke and pressure-receiving area Aa of the pneumatic cylinder 32 which are determined for the specific die set used on the press. The operating stroke of the cylinder 32 for the specific die set is stored as the die set information in the ID card 66 attached to the punch 10 of that die set.

Since the diagnosis is effected with the press slide 20 kept at its lower stroke end, the operator does not have to depress the TEST OPERATION switch each time the in-process blank-holding force $Fs_n$ is decremented. In this sense, the diagnosis according to this second embodiment is fully automated, and the time required for the diagnosis is reduced. The first embodiment may be modified so that the test operation is automatically performed after the pneumatic pressure Pa is adjusted in step S4.

Referring to the flow charts of FIGS. 12A and 12B, a third embodiment of this invention will be described. The diagnostic routine according to this embodiment is initiated with step R1 to determine whether the AUTO-MANUAL selector switch 72 on the operator's control panel 68 is set at "AUTO". If an affirmative decision (YES) is obtained in step R1, the control flow goes to step R2 to determine whether the SETUP pushbutton 74 has been depressed. If the pushbutton 74 is depressed with the AUTO-MANUAL switch 72 placed in the AUTO position, step R3 is implemented to calculate a reference value $\Delta Psx^*$ according to the following equation (8):

$$\Delta Psx^* = \Delta Fs/n.As \quad (8)$$

Figure 1:
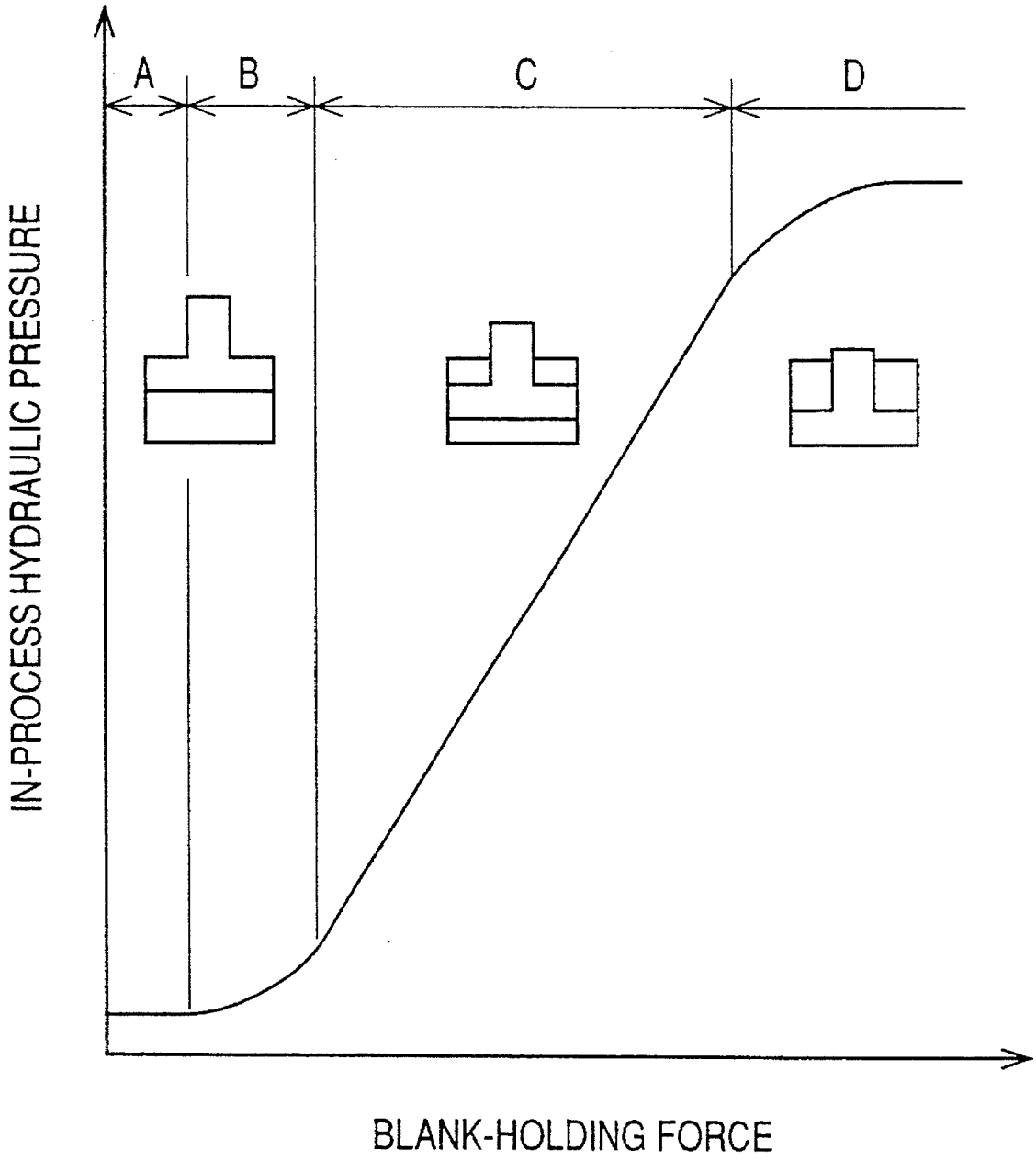
FIG. 1 is a view explaining a relationship between a blank-holding force produced by a cushioning device of a press and a hydraulic pressure in balancing hydraulic cylinders of the cushioning device.
Figure 2A:
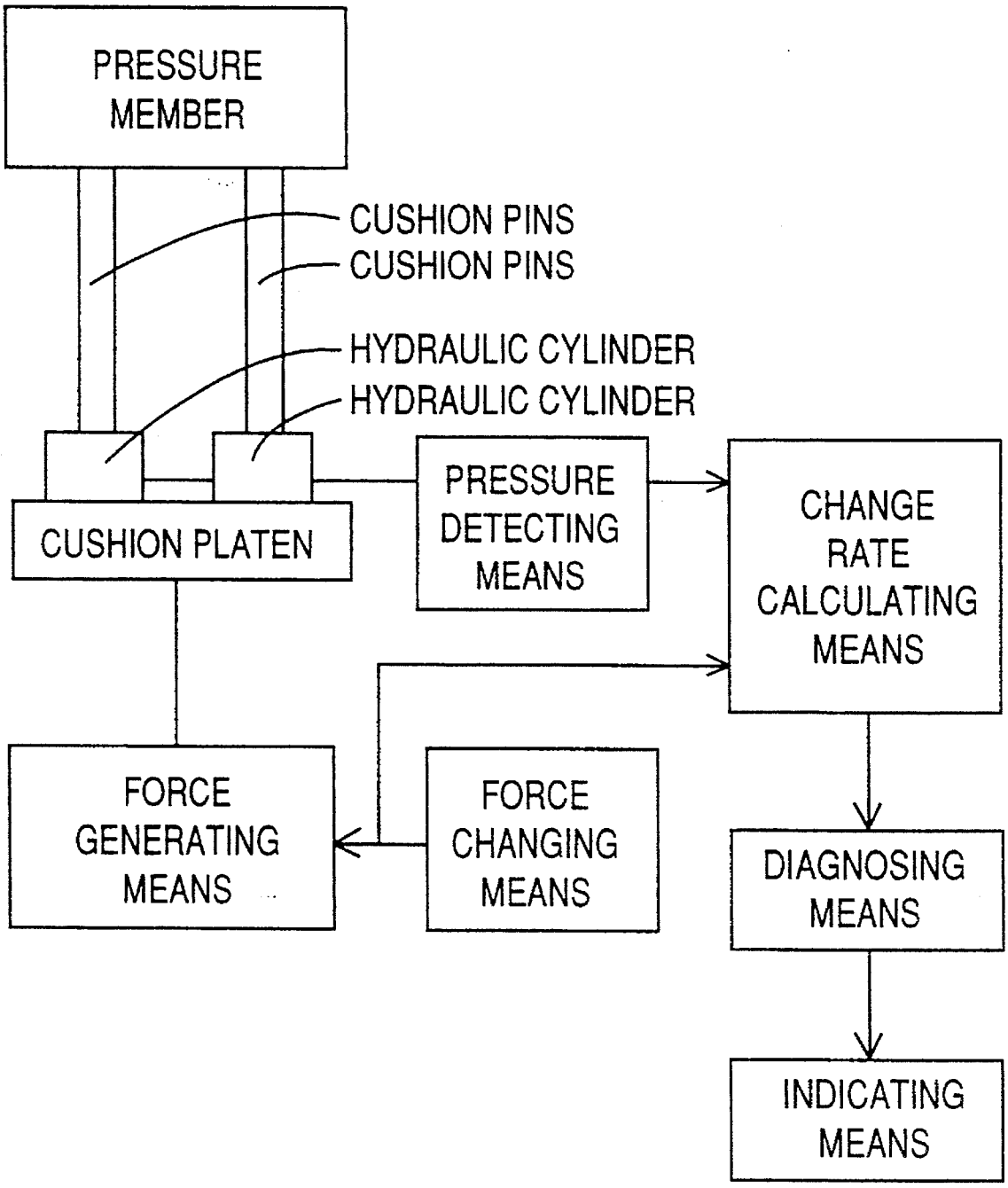
FIGS. 2A, 2B and 2C are block diagrams schematically illustrating arrangements for diagnosing the cushioning apparatus according to different aspects of the present invention.
Figure 2B:
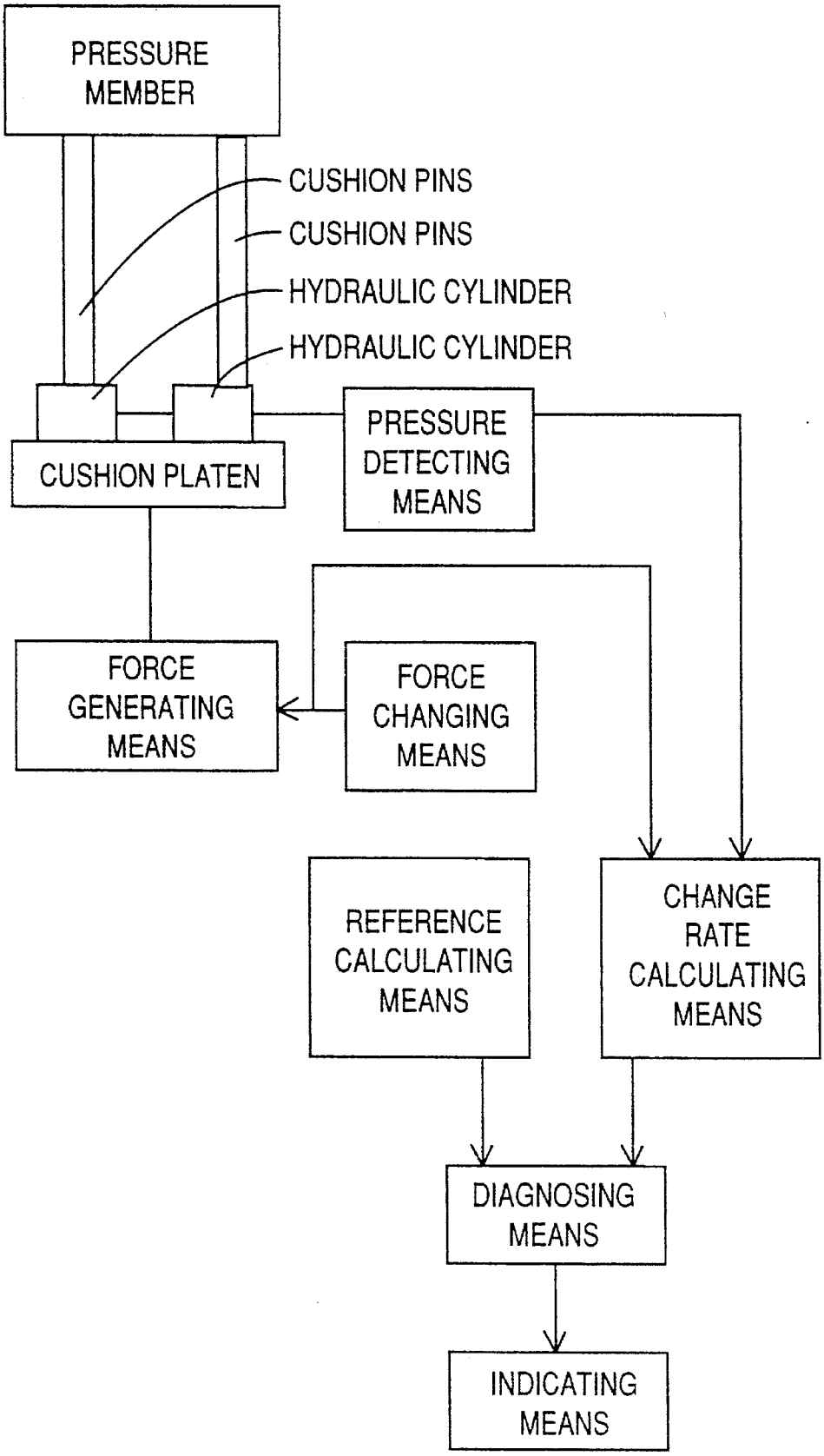
Figure 2C:
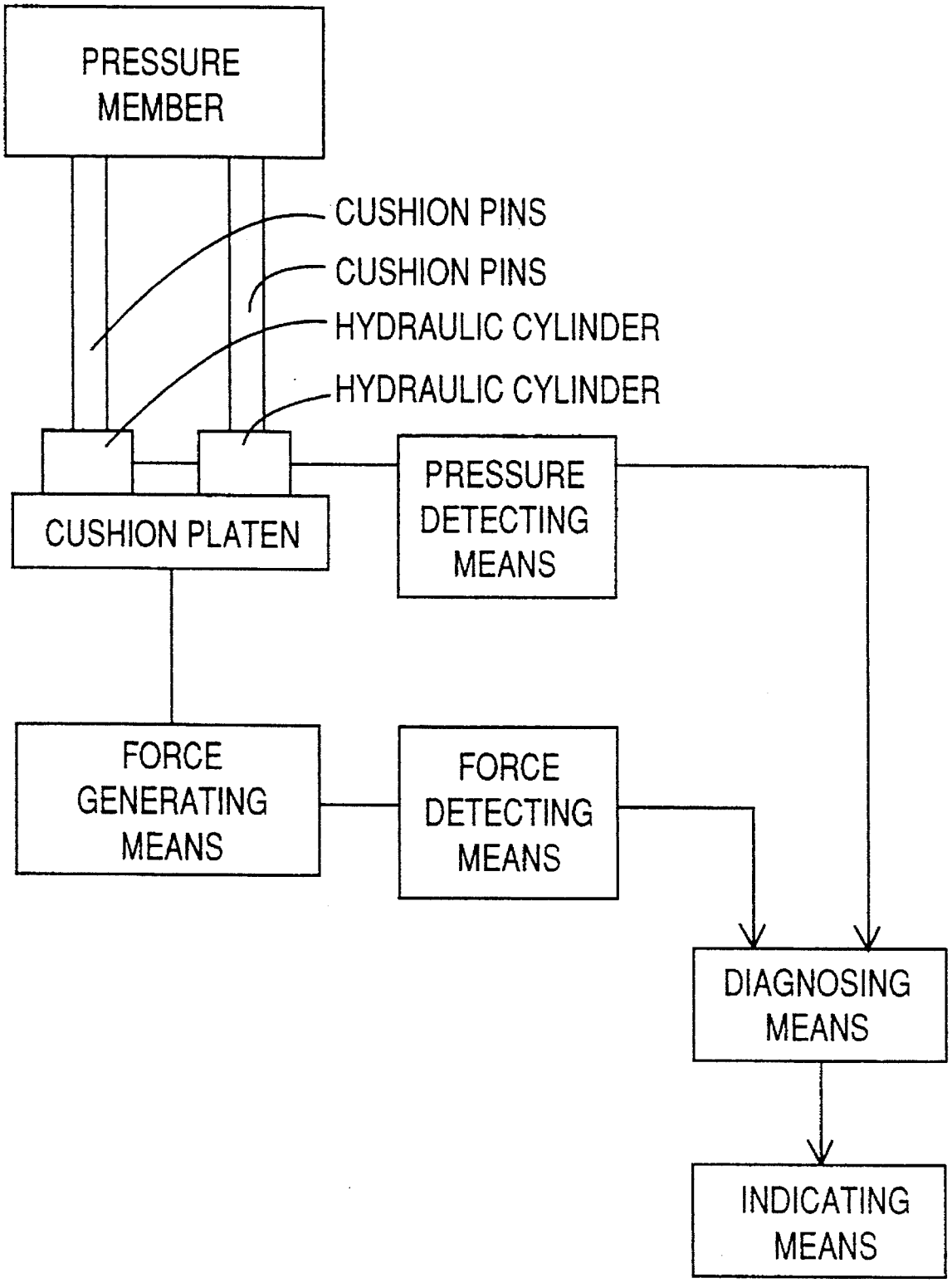

The above equation (8) is formulated to obtain as the reference value $\Delta Psx^*$ an amount of change $\Delta Psx$ of the hydraulic pressure Psx which corresponds to an amount of change $\Delta Fs$ of the blank-holding force Fs within the optimum range C indicated in FIGS. 1 and 8. Since the blank-holding force is decremented by the constant amount $\Delta Fs$ for each test pressing action, the amount of change $\Delta Psx$ of the hydraulic pressure Psx corresponding to the amount of change $\Delta Fs$ represents a rate of change of the hydraulic pressure Psx. The equation (8) is formulated based on the above equation (3). The amount of change $\Delta Fs$ of the blank-holding force Fs is an amount of change of the initial blank-holding force $Fs_n$ to be set in step R4. In the present embodiment, the amount of change $\Delta Fs$ is 20 tons. The pressure-receiving area As of the hydraulic cylinders 30 is stored as the machine information, while the number n of the cushion pins 22 is received as part of the die set information from the ID card 66. If a test pressing operation indicates the need of changing the number n of the cushion pins 22, the number n used in the equation (8) may be changed through the PIN NUMBER setting dials 75 on the control panel 68. It is noted that the above equation (3) represents the relationship between the hydraulic pressure Psx and the blank-holding force Fs upon detection of the hydraulic pressure Psx. Therefore, where the hydraulic pressure Psx is detected at the lower stroke end of the press slide 20, for example, it is desirable to calculate the reference value $\Delta Psx^*$ on the basis of the amount of change $\Delta Fs$ of the blank-holding force Fs when the press slide 20 is at its lower stroke end. In this respect, it is desirable that the amount of change $\Delta Fs$ of the initial blank-holding force Fs be adjusted to the amount of change of the in-process blank-holding force Fs at the lower stroke end of the slide 20, on the basis of the operating stroke and pressure-receiving area Aa of the pneumatic cylinder 32. It is possible to detect the pneumatic pressure Pa at a point of time subsequent to step R4, and obtain the amount of change $\Delta Fs$ by multiplying an amount of change $\Delta Pa$ of the detected pneumatic pressure Pa by the pressure-receiving area Aa of the pneumatic cylinder 32.

Steps R4 through R9 are identical with steps S3 through S8 in the first embodiment of FIGS. 6A and 6B, respectively. With these steps R4–R9 implemented, the hydraulic pressure value $Psx_n$ corresponding to each initial blank-holding force $Fs_n$ set in step R4 is detected and stored in the RAM of the control unit 62. Step R9 is followed by step R10 to calculate the amount of change $\Delta Psx_n$ of the hydraulic pressure $Psx_n$, which is equal to $|Psx_n - Psx_{n-1}|$. Step R10 is followed by step R11 to determine whether the difference $|\Delta Psx_n - \Delta Psx^*|$ is equal to or smaller than a predetermined tolerance value $\beta$. The value $\Delta Psx^*$ has been discussed above with respect to step R3. The tolerance value $\beta$ is for determining whether the amount of change $\Delta Psx_n$ is substantially equal to the reference value $\Delta Psx^*$ or not, and is determined in the same manner as the tolerance value $\alpha$ used in step S11 of the diagnostic routine in the first embodiment of FIGS. 6A and 6B.

If the difference $|\Delta Psx_n - \Delta Psx^*|$ is equal to or smaller than the tolerance value $\beta$, step R12 is implemented to set the flag F to "1", and step R13 is then implemented to turn on the indicator light 78 corresponding to the blank-holding force value $Fs_{n-1}$ which was set in step R4 in the last cycle n-1. If the above difference is larger than the tolerance value $\beta$, step R11 is followed by step R14 to determine whether the flag F is set at "1". If an affirmative decision (YES) is obtained in step R14, step R15 is implemented to reset the flag F to "0", and step R13 is then implemented to turn on the indicator light 78 corresponding to the force value $Fs_{n-1}$.

If a negative decision (NO) is obtained in step R14, or after completion of step R13, the control flow goes to step R16 to determine whether the blank-holding force $Fs_n$ currently set is 20 tons, namely to determine whether the hydraulic pressure values Psx corresponding to all of the ten blank-holding force values $Fs_1$ through $Fs_{10}$ have been stored in the control unit 62. Thus, step R4 and the following steps are repeatedly implemented until the force value $Fs_n$ current set is decremented down to 20 tons. In the first cycle with the force value $Fs_1$=200 tons, steps R10 through R15 are skipped, and step R9 is directly followed by step R16.

If the in-process hydraulic pressure $Psx_n$ changes with the initial blank-holding force $Fs_n$ as indicated in the graph of FIG. 8, the amount of change $\Delta Psx_n$ of the in-process hydraulic pressure $Psx_n$ is substantially equal to the reference value $\Delta Psx^*$ over the range C of the force $Fs_n$ from 120 tons ($Fs_5$) to 40 tons ($Fs_9$). Described in detail, in the sixth cycle with the force $Fs_6$=100 tons, the amounts of change $\Delta Psx_n$ and the reference value $\Delta Psx^*$ are substantially equal to each other, and the difference $|\Delta Psx_n-\Delta Psx^*|$ is smaller than the tolerance value β, whereby the affirmative decision (YES) is obtained in step R11, so that the indicator light 78 corresponding to the force value $Fs_{n-1}$=Fs5=120 tons is turned on in step R13. In the seventh, eighth and ninth cycles with the force values $Fs_7$=80 tons, $Fs_8$=60 tons and $Fs_9$=40 tons, the indicator lights 78 corresponding to the force values $Fs_6$=100 tons, $Fs_7$=80 tons and $Fs_8$=60 tons are turned on in step R13, since the difference $|\Delta Psx_n-\Delta Psx^*|$ is smaller than the tolerance value β. In the tenth or last cycle with the force $Fs_{10}$=20 tons, the amount of change $\Delta Psx_{10}$ is reduced, and the negative decision (NO) is obtained in step R1, whereby step R4 is implemented. Since the flag F was set to "1" in the ninth cycle, the affirmative decision (YES) is obtained in step R15, and step R13 is implemented to turn on the indicator lights 78 corresponding to the force value $Fs_9$=40 tons. Thus, the five indicator lights 78 are turned on during the test operation, indicating the optimum range C from 120 tons to 40 tons, as in the example of the first embodiment, as shown in FIG. 5B. In the optimum range C of the initial blank-holding force Fsn as indicated in FIGS. 1 and 8, the amount of change ΔPsx of the in-process hydraulic pressure Psx is substantially equal to the reference value $\Delta Psx^*$. In this optimum range C, the pistons of all hydraulic cylinders 30 linked with the cushion pins 22 are placed in their neutral positions between their upper and lower stroke ends, whereby the in-process blank-holding force Fs can be substantially evenly distributed on the pressure ring 28.

Figure 12A:
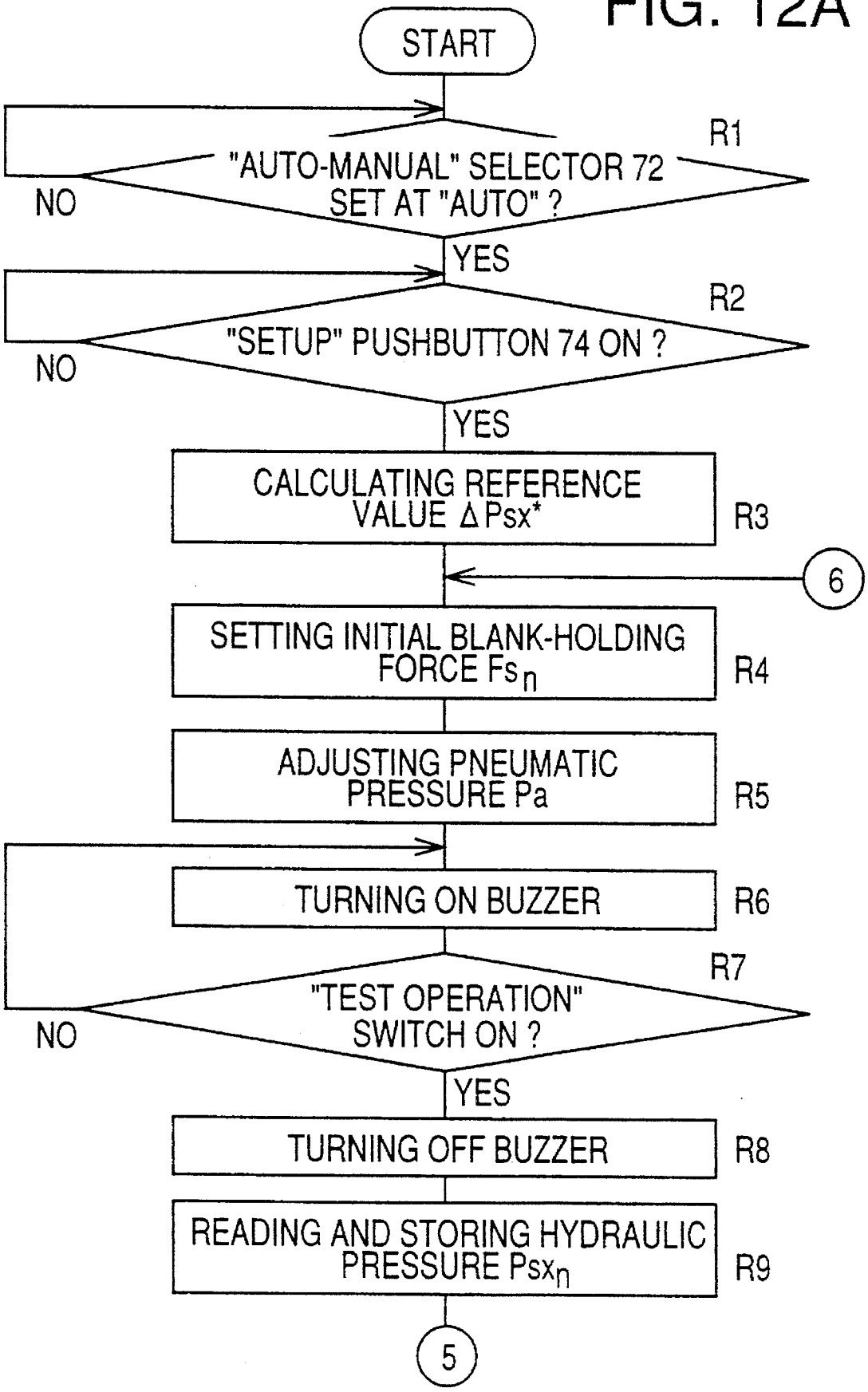
FIGS. 12A and 12B are flow charts illustrating a diagnosing routine according to a further embodiment of the invention.
Figure 12B:
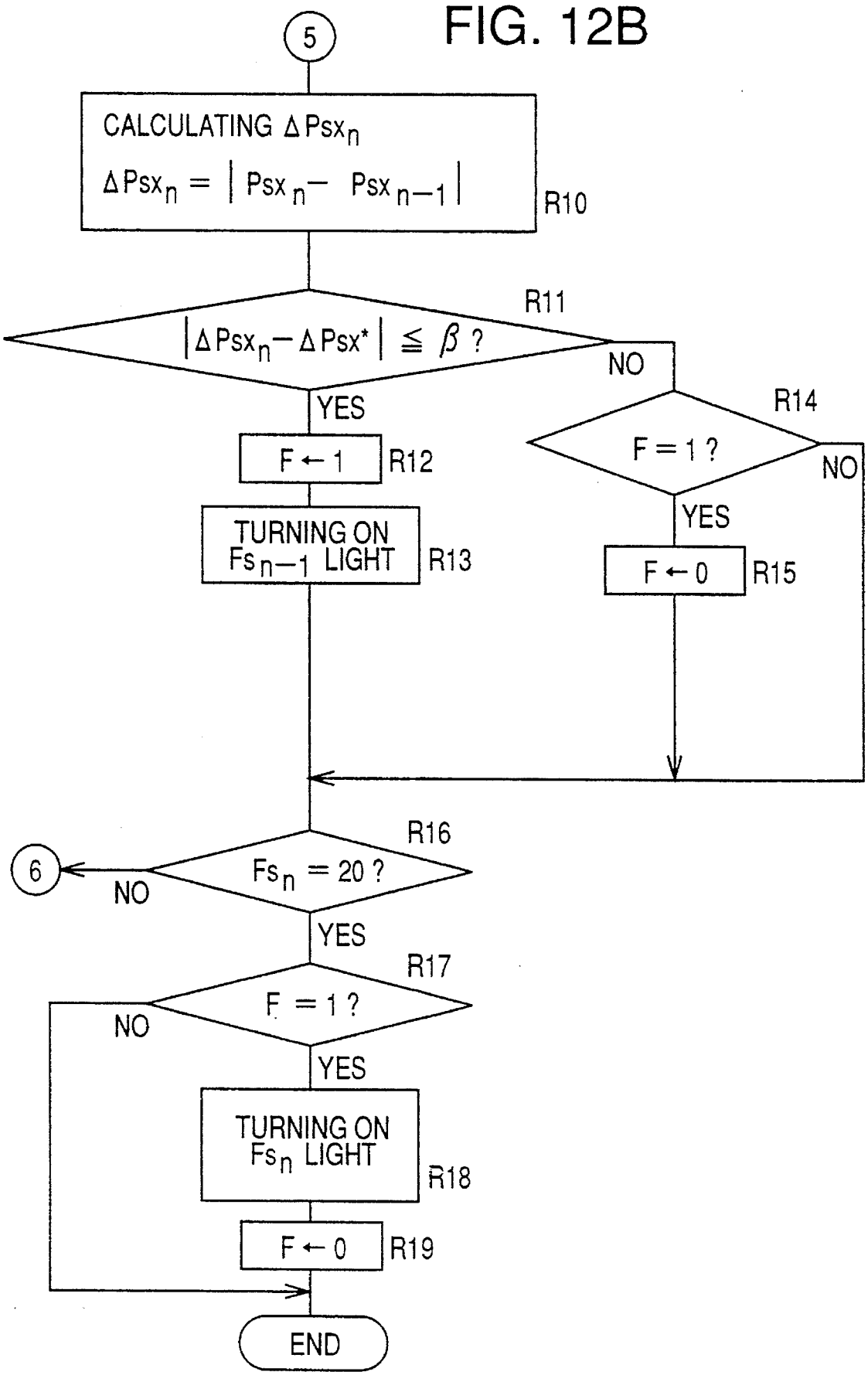

The third embodiment of FIGS. 12A and 12B provides the same advantages as the first embodiment. Further, the diagnosis is possible with at least two hydraulic pressure values Psx corresponding to at least two different initial blank-holding force values Fs. In this respect, the first embodiment requires at least three hydraulic pressure values Psx. In the present third embodiment, therefore, the amount of change ΔFs of the blank-holding force $Fs_n$ to be set in step R4 may be made larger than in the first embodiment, whereby the diagnosis may be simplified.

In the present third embodiment, the step R3 implemented by the control unit 62 is a step of calculating the reference value $\Delta Psx^*$, and steps R4, R5 and R9 also implemented by the control unit 62 correspond to a step of detecting the in-process hydraulic pressure $Psx_n$. It will be further understood that the portion of the control unit 62 assigned to implement step R3 constitutes means for calculating the reference value $\Delta Psx^*$, while the portion of the control unit 62 assigned to implement step R10 constitutes means for calculating the rate of change of the hydraulic pressure $Psx_n$ with the initial blank-holding force $Fs_n$. Further, the portion of the control unit 62 assigned to implement steps R11, R13 and R18 constitutes means for diagnosing the cushioning device 44 on the optimum range C of the initial blank-holding force $Fs_n$, while the portion of the control unit 62 assigned to implement steps R4, R5 and R16 cooperates with the shut-off valve 37 and pneumatic pressure control circuit 38 to constitute means for changing the blank-holding force Fs. The portion of the control unit 62 assigned to implement step R9 cooperates with the hydraulic pressure sensor 60 to constitute means for detecting the hydraulic pressure $Psx_n$.

Figure 13A:
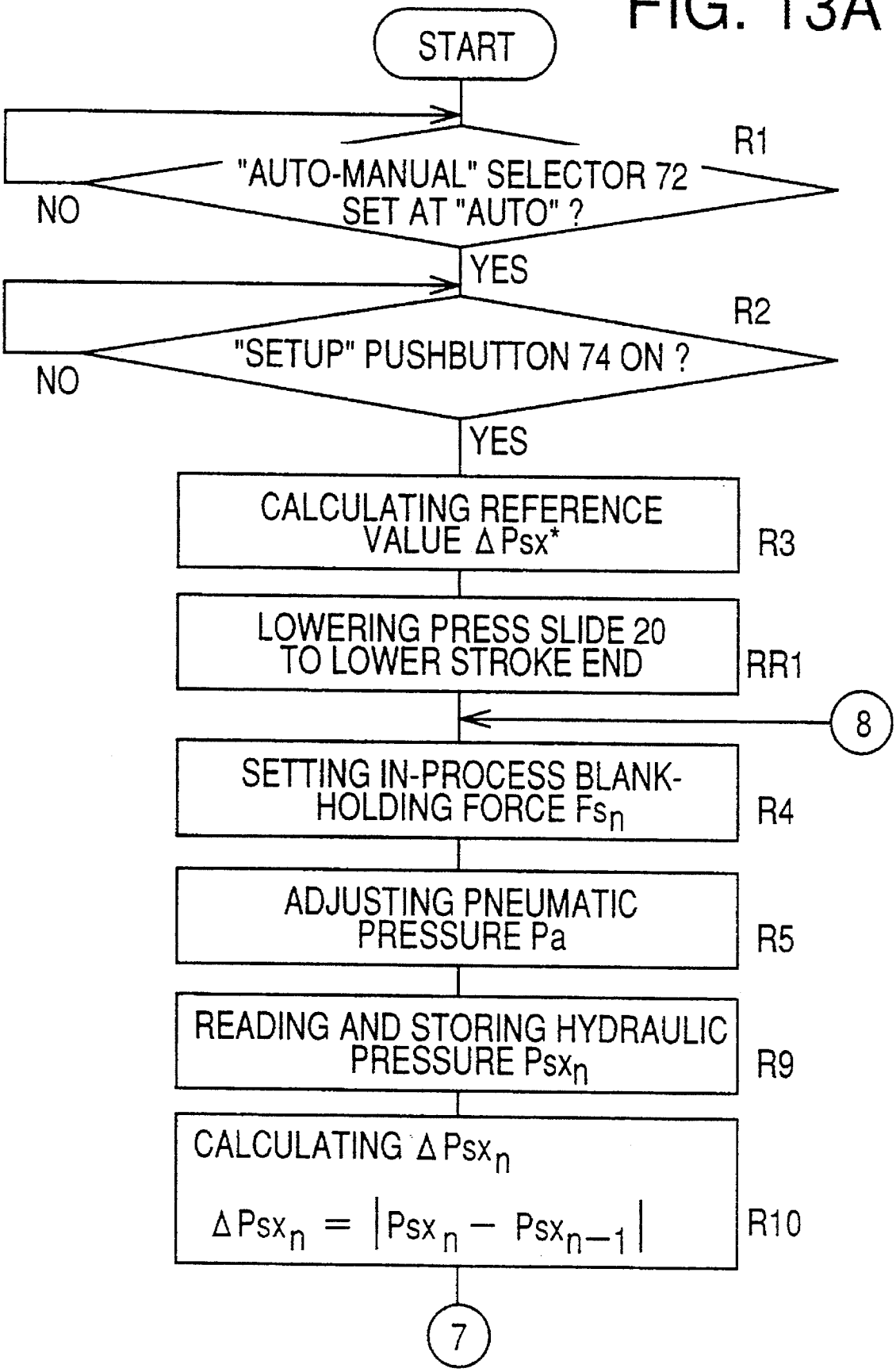
FIGS. 13A and 13B are flow charts showing a still further embodiment of the invention.
Figure 13B:
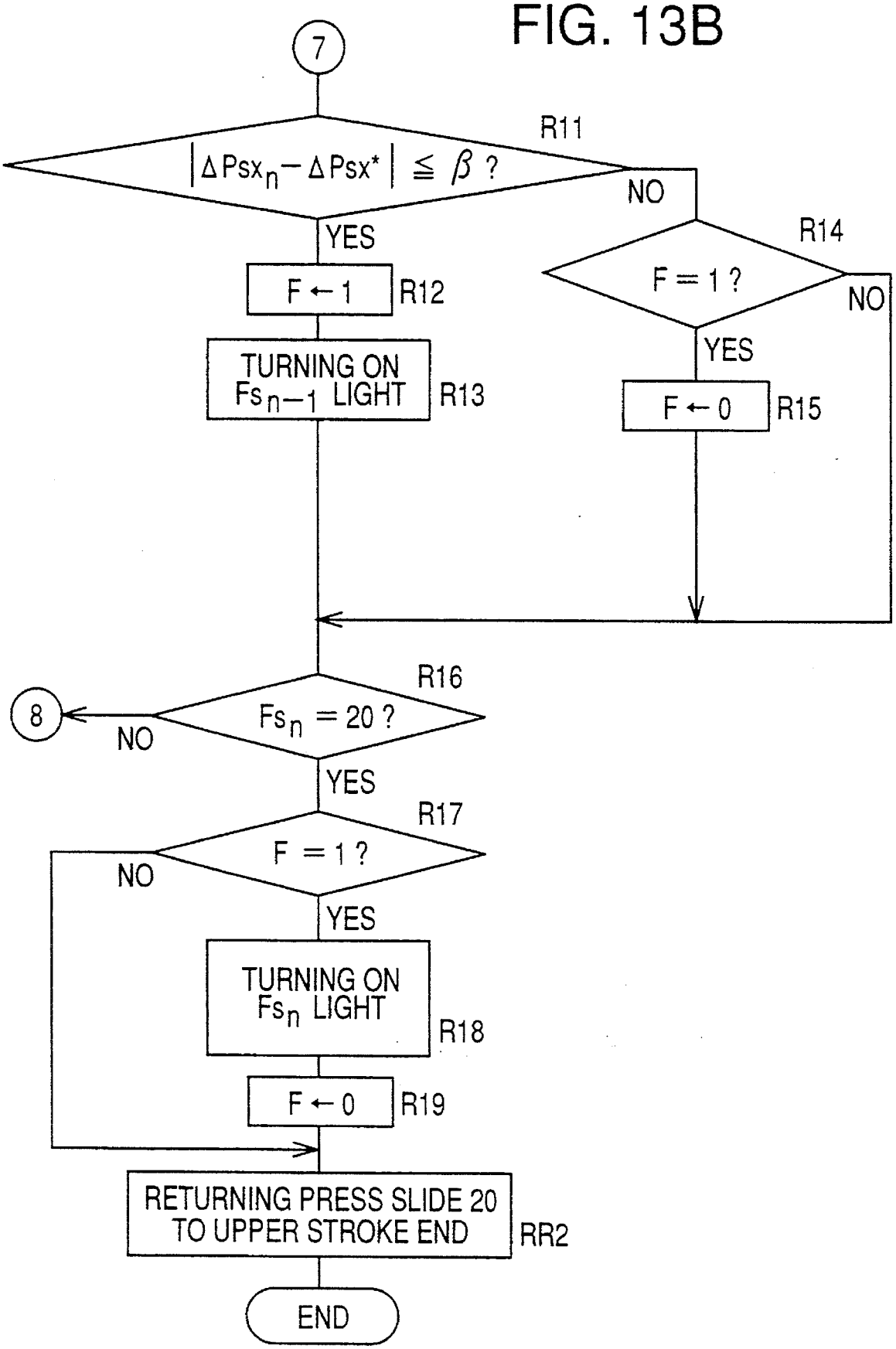

Referring next to the flow charts of FIGS. 13A and 13B, there will be described a fourth embodiment of this invention, which is different from the third embodiment only in that the diagnosis is effected with the press slide 20 held at its lower stroke end. Described more specifically, step R3 is followed by step RR1 to lower the press slide 20 to its lower stroke end. In the following step R4, the in-process blank-holding force $Fs_n$ (n=1~10) when the press slide 20 is at its lower stroke end is set. The in-process blank-holding force $Fs_n$ is decremented by 20 tons from 200 tons to 20 tons. The in-process force value $Fs_n$ at the lower stroke end of the press slide 20 is greater than the initial force value $Fs_n$ upon abutting contact of the upper die 18 with the blank 40 (described above with respect to the first embodiment), by an amount corresponding the amount of volumetric reduction of the pneumatic cylinder 32 due to the lowering movement of the press slide 20. In this respect, therefore, it is possible to accordingly raise the in-process blank-holding force $Fs_n$ to be set in step S3 in the present second embodiment.

Step R5 is then implemented to adjust the pneumatic pressure Pa according to the above equation (7) so that the blank-holding force Fs is adjusted to the value $Fs_n$ set in step R4. Then, step R9 and the following steps are implemented to detect and store the in-process hydraulic pressure $Psx_n$, calculate the amount of change $\Delta Psx_n$, determine whether the difference $|\Delta Psx_n-\Delta Psx^*|$ is equal to or smaller than the tolerance value β, and activate the appropriate indicator lights 78, as in the third embodiment. Step R4 and the following steps are repeatedly implemented with the in-process blank-holding force $Fs_n$ being decremented, to eventually diagnose the cushioning device 44 on the optimum range C of the in-process blank-holding force $Fs_n$. Step RR2 is finally implemented to return the press slide 20 to the upper stroke end, and the diagnostic routine is ended. The pneumatic pressure Pa may be adjusted prior to step RR1 so that the initial blank-holding force is about 200 tons. In this case, the pneumatic pressure Pa is lowered to a level corresponding to the in-process blank-holding force $Fs_n$ set in step R4.

In the present fourth embodiment, the in-process blank-holding force $Fs_n$ when the press slide 20 is at its lower stroke end is diagnosed as in the second embodiment of FIGS. 11A and 11B. The optimum in-process blank-holding force Fs can be established within the optimum range, by adjusting the initial blank-holding force, more precisely, by adjusting the initial pneumatic pressure Pa of the pneumatic cylinder 32, for example, on the basis of the operating stroke and pressure-receiving area Aa of the pneumatic cylinder 32 which are determined for the specific die set used on the press. The operating stroke of the cylinder 32 for the specific die set is stored as the die set information in the ID card 66 attached to the punch 10 of that die set.

Since the diagnosis is effected with the press slide 20 kept at its lower stroke end, the operator does not have to depress the TEST OPERATION switch each time the in-process blank-holding force $Fs_n$ is decremented. In this sense, the diagnosis according to this fourth embodiment is fully automated, and the time required for the diagnosis is reduced. The third embodiment may be modified so that the test operation is automatically performed after the pneumatic pressure Pa is adjusted in step R5.

Figure 14A:
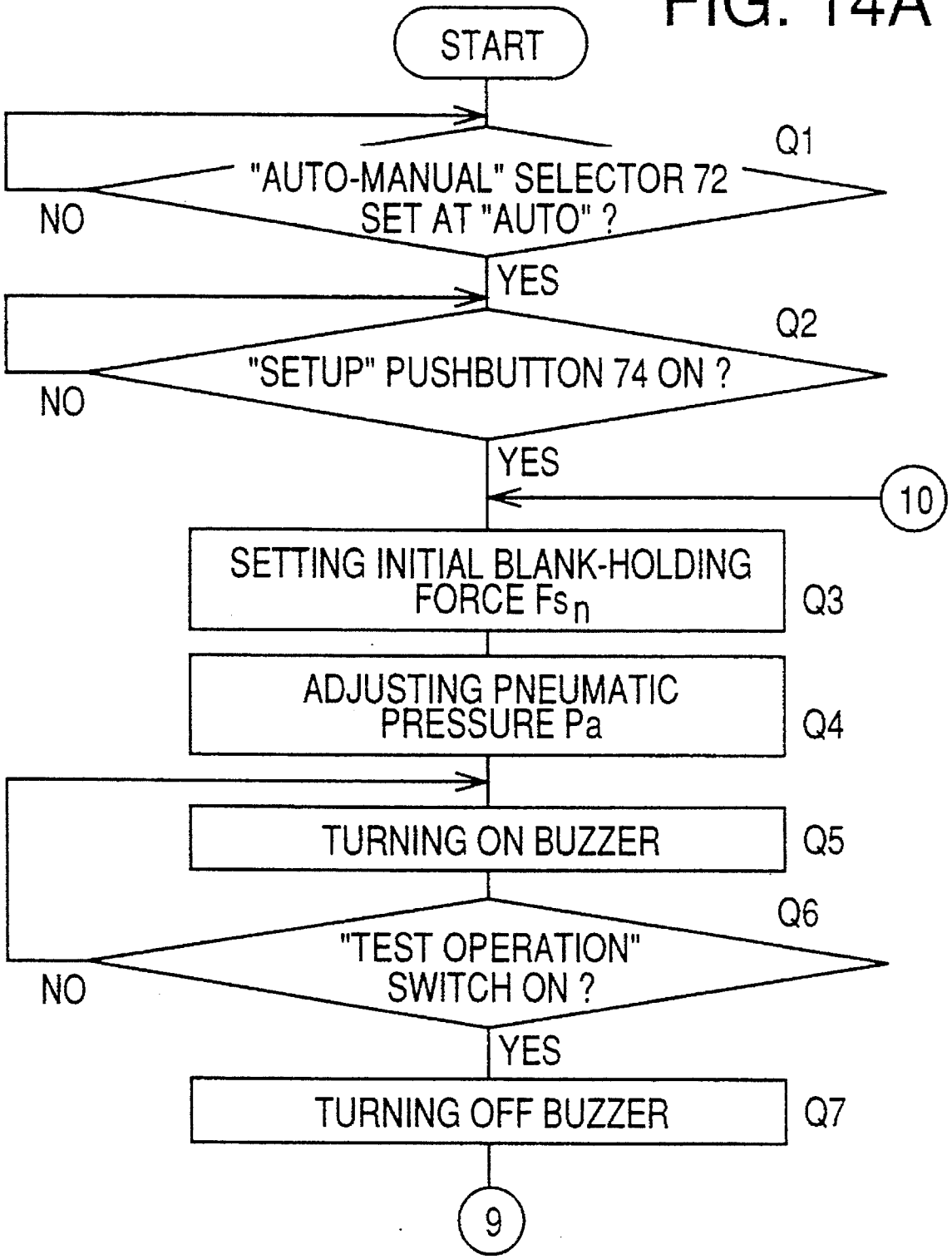
FIGS. 14A and 14B are flow charts showing a yet further embodiment of the invention.
Figure 14B:
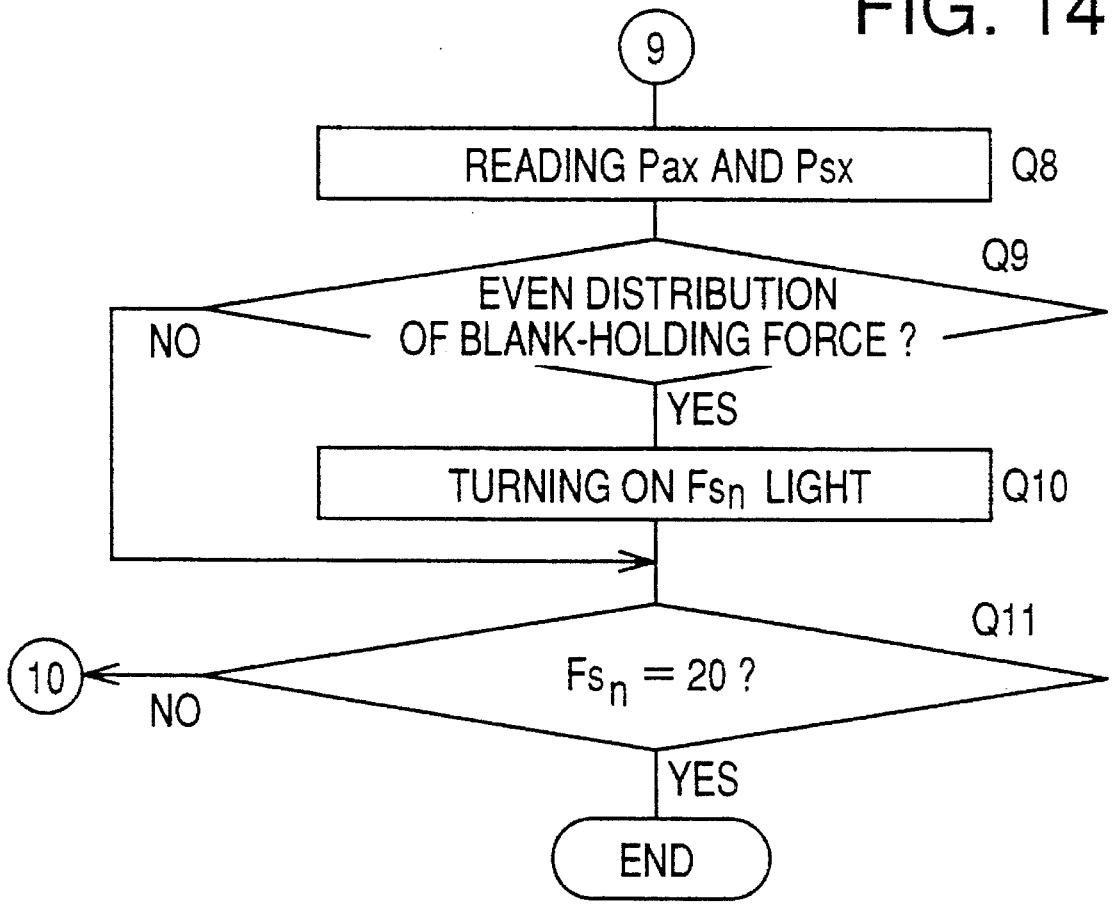

Reference is now made to the flow charts of FIGS. 14A and 14B, which illustrate a fifth embodiment of the invention wherein steps Q1 through Q7 are identical with steps S1 through S7 of the first embodiment of FIGS. 6A and 6B. In the next step Q8, the in-process pneumatic and hydraulic pressures Pax and Psx at the lower stroke end of the press slide 20 are detected. Step Q8 is followed by step Q9 to determine whether the following formula (9) is satisfied or not, to thereby determine whether the blank-holding force is evenly distributed on the pressure ring 28.

$$|Aa \cdot Pax - Wa - n \cdot As \cdot Psx| \leqq \gamma \quad (9)$$

The formula (9), which corresponds to the above formula (6), is formulated to effect the diagnosis on the in-process blank-holding force Fs when the press slide 20 is at its lower stroke end. That is, the formula (9) is formulated so as to take into account the increase of the pneumatic pressure Pa due to the volumetric reduction of the pneumatic cylinder 32 at the lower stroke end of the press slide 20. Namely, the pneumatic pressure Pa is higher when the slide 20 is at its lower stroke end than that when the slide 20 is located at a position of abutting contact of the upper die 18 with the blank 40 (pressure ring 28). The tolerance value γ used in the formula (9) is about 2 tons, for example. The pressure-receiving areas Aa, As and the weight Wa used in the formula (9) are stored as the machine information, and the number n of the cushion pins 22 is received as the die set information from the ID card 66. As described above, the number n may be changed through the PIN NUMBER setting dials 75, as desired. If the formula (9) is satisfied, it is considered that the blank-holding force Fs is evenly distributed on the cushion pins 22, and the control flow goes to step Q10 to turn on the indicator light 78 which corresponds to the currently set initial blank-holding force value $Fs_n$. Step Q11 is then implemented to determine whether the currently set initial blank-holding force $Fs_n$ is 20 tons, that is, whether the diagnosis has been completed on all of the ten initial blank-holding force values $Fs_n$. Step Q3 and the following steps are repeatedly implemented until the affirmative decision (YES) is obtained in step Q11.

The present fifth embodiment has the same advantages as the first and third embodiments of FIGS. 6A, 6B, 12A and 12B. In addition, the present embodiment of FIGS. 14A and 14B permits the diagnosis on the in-process pneumatic and hydraulic pressure values Pax and Psx which correspond to a single desired initial blank-holding force value $Fs_n$. Consequently, the amount of change ΔFs of the initial blank-holding force value $Fs_n$ to be set in step Q3 may be made relatively large. Further, it is not necessary to decrement or increment the initial blank-holding force Fsn by a predetermined constant amount. Namely, the force value $Fs_n$ may be changed at random. Accordingly, the diagnosis may be considerably simplified.

In the fifth embodiment, the portion of the control unit 62 assigned to implement step Q8 cooperates with the pneumatic and hydraulic pressure sensors 39, 60 to constitute means for detecting the pneumatic pressures Pax, Psx, respectively. Further, the portion of the control unit 62 assigned to implement step Q9 constitutes means for diagnosing the cushioning device 44 on the blank-holding force Fs.

Referring next to the flow charts of FIG. 15, there will be described a sixth embodiment of this invention, which is different from the fifth embodiment only in that the diagnosis is effected with the press slide 20 held at its lower stroke end. Described more specifically, when the affirmative decision (YES) is obtained in step Q2, step QQ1 is implemented to lower the press slide 20 to its lower stroke end. In the following step Q3, the in-process blank-holding force $Fs_n$ (n=1~10) when the press slide 20 is at its lower stroke end is set. The in-process blank-holding force $Fs_n$ is decremented by 20 tons from 200 tons to 20 tons. The in-process force value $Fs_n$ at the lower stroke end of the press slide 20 is greater than the initial force value $Fs_n$ upon abutting contact of the upper die 18 with the blank 40 (described above with respect to the first embodiment), by an amount corresponding the amount of volumetric reduction of the pneumatic cylinder 32 due to the lowering movement of the press slide 20. In this respect, therefore, it is possible to according raise the in-process blank-holding force $Fs_n$ to be set in step Q3 in the present second embodiment.

Step Q4 is then implemented to adjust the pneumatic pressure Pa so that the blank-holding force Fs is adjusted to the value $Fs_n$ set in step Q3. Then, step Q8 and the following steps are implemented to detect and store the in-process hydraulic pressure values $Psx_n$ corresponding to all in-process blank-holding force values $Fs_n$. Step QQ2 is finally implemented to return the press slide 20 to the upper stroke end, and the diagnostic routine is ended. Since the pneumatic pressure Pa adjusted in step Q4 is the pressure Pax when the press slide 20 is at its lower stroke end, it is not necessary to detect the in-process pneumatic pressure Pax in step QS, and the diagnosis in step Q9 is effected on the basis of the pneumatic pressure Pa (in-process value Pax) as adjusted in step Q4 and the in-process hydraulic pressure Psx detected in step QS. The pneumatic pressure Pa may be adjusted prior to step QQ1 so that the initial blank-holding force is about 200 tons. In this case, the pneumatic pressure Pa is lowered to a level corresponding to the in-process blank-holding force $Fs_n$ set in step Q3. Further, the diagnosis in step Q9 may be made according to the following equation (10), on the basis of the in-process blank-holding force $Fs_n$ and the in-process hydraulic pressure Psx when the slide 20 is at its lower stroke end:

$$|Fs_n + n \cdot Wp + Wr - n \cdot As \cdot Psx| \leqq \gamma \quad (10)$$

In the present sixth embodiment, the in-process blank-holding force $Fs_n$ when the press slide 20 is at its lower stroke end is diagnosed as in the second and fourth embodiments of FIGS. 11A, 11B, 13A, 13B. The optimum in-process blank-holding force Fs can be established within the optimum range, by adjusting the initial blank-holding force, more precisely, by adjusting the initial pneumatic pressure Pa of the pneumatic cylinder 32, for example, on the basis of the operating stroke and pressure-receiving area Aa of the pneumatic cylinder 32 which are determined for the specific die set used on the press. The operating stroke of the cylinder 32 for the specific die set is stored as the die set information in the ID card 66 attached to the punch 10 of that die set.

Since the diagnosis is effected with the press slide 20 kept at its lower stroke end, the operator does not have to depress the TEST OPERATION switch each time the in-process blank-holding force $Fs_n$ is decremented. In this sense, the diagnosis according to this sixth embodiment is fully automated, and the time required for the diagnosis is reduced. The fifth embodiment may be modified so that the test operation is automatically performed after the pneumatic pressure Pa is adjusted in step Q4.

Figure 15:
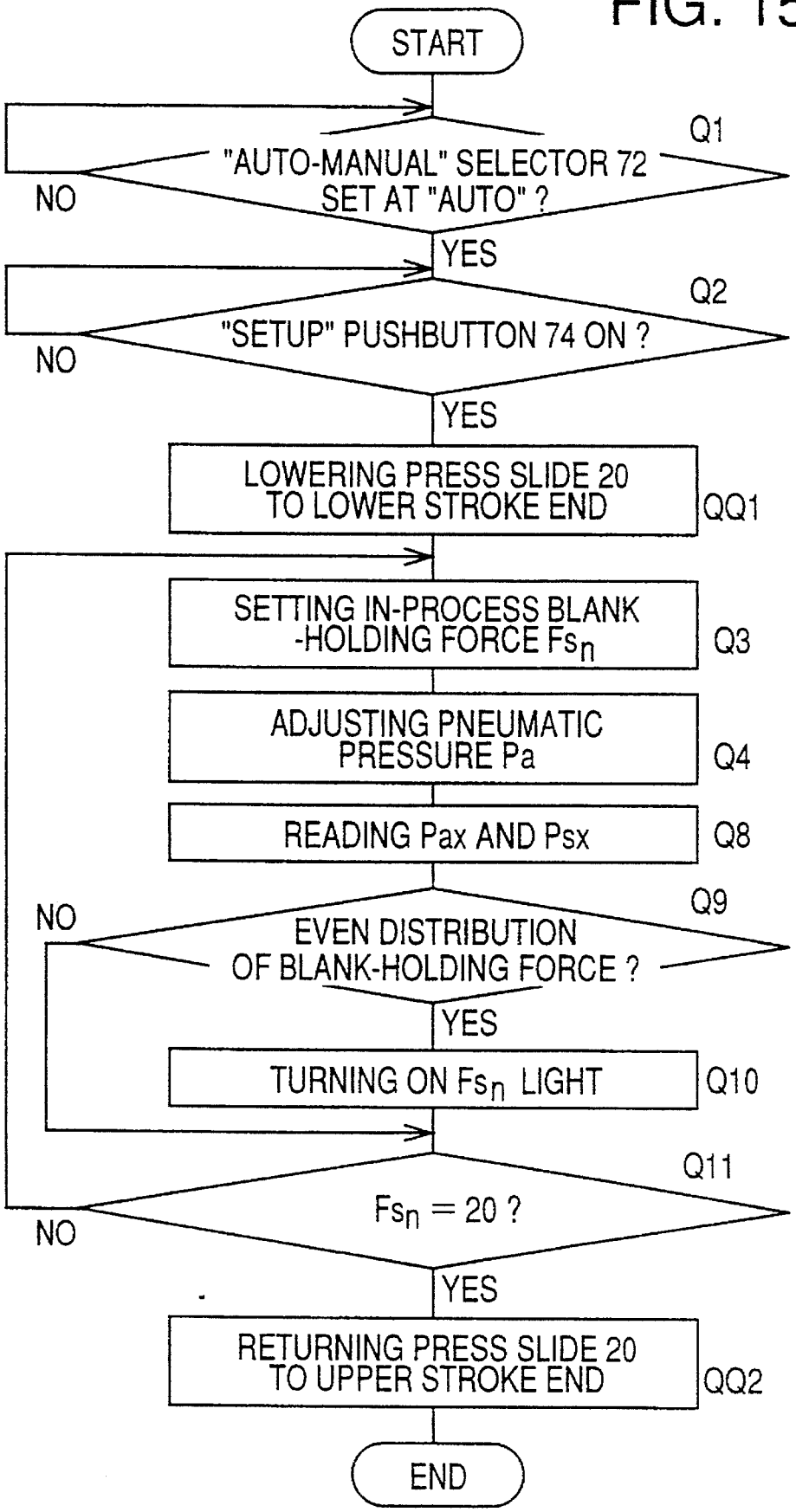
FIG. 15 is a flow chart showing still another embodiment of the invention.

In the present sixth embodiment of FIG. 15, the portion of the control unit 62 assigned to implement step Q4 (for adjusting the pneumatic pressure Pa according to the set in-process blank-holding force $Fs_n$) cooperates with the pneumatic pressure sensor 39 to constitute means for detecting the in-process pneumatic pressure Pax, while the portion of the control unit 62 assigned to implement step Q8 cooperates with the hydraulic pressure sensor 60 to constitute means for detecting the in-process hydraulic pressure Pax.

There will next be described a seventh embodiment of this invention, by reference to the flow chart of FIG. 16. In this embodiment, the operator's control panel 68 is modified so as to include: setting switches used by the operator to set an optimum initial blank-holding force Fso and an optimum initial hydraulic pressure Pso, as desired; and indicators for indicating changes of the pneumatic and hydraulic pressures Pa, Ps in relation to the reciprocating movement (operating stroke) of the press slide 20, and even and uneven distribution states of the blank-holding force, as illustrated in FIG. 17. After the optimum initial blank-holding force Fso and the optimum initial hydraulic pressure Pso are set through the above-indicated setting switches, the AUTO-MANUAL selector switch 72 turned to the MANUAL position, and the SETUP pushbutton 74 is depressed. As a result, an affirmative decision (YES) is obtained in steps W1 and W2, whereby step W3 is implemented to adjust the pneumatic pressure Pa according to the above equation (7) so as to establish the set optimum initial blank-holding force Fso, and also adjust the hydraulic pressure Ps to the set optimum initial value Pso.

The following steps W4 through W6 are identical with steps S5 through S7 of the first embodiment of FIGS. 6A and 6B. Step W7 is then implemented to reciprocate the press slide 20 in the inching mode, that is, moved down to the lower stroke end and moved up back to the upper stroke end, by a predetermined incremental distance. Step W7 is followed by step W8 to detect and store the pneumatic and hydraulic pressures Pa, Ps after the slide 20 has moved the incremental distance. The detected pressure values Pa, Ps are indicated on the operator's control panel. The control flow then goes to step W9 to determine whether the above equation (9) is satisfied or not, to thereby determine whether the blank-holding force is evenly distributed on the pressure ring 28. If the equation (9) is satisfied, step W10 is implemented to provide on the operator's control panel an indication that the current blank-holding force is evenly distributed. Step W11 is then implemented to determine whether the press slide 20 has returned to the upper stroke end. Steps W7 through W11 are repeatedly implemented until the slide 20 has returned to the upper stroke end. Thus, the diagnosis on the even distribution of the blank-holding force is effected for each set of the pneumatic and hydraulic pressure values Pa, Ps obtained for each inching movement of the slide 20 over the entire operating stroke of the slide.

The graphs of FIG. 17 indicate examples of indication of the pneumatic and hydraulic pressures Pa, Ps in relation to the reciprocating movement of the press slide 20, and an example of indication of an optimum range C of the pressures Pa, Ps within which the blank-holding force is considered to be evenly distributed on the pressure ring 28. Thus, the operator can recognize the optimum range C of the pressures Pa, Ps during a pressing cycle. Further, the indication of the pneumatic and hydraulic pressures Pa, Ps in relation to the position of the slide 20 permits the operator to know the critical points of the slide 20 during its reciprocation, for example, a point SP1 at which the upper die 18 abuts on the pressure ring 28 (blank 40), and a lower stroke end SP2, as indicated in FIG. 17. This arrangement eliminates a position sensor for producing the LOWER STROKE END SD signal as used in step S8 of the first embodiment of FIG. 6A, and makes it possible to calculate the optimum range C on the basis of the points SP1 and SP2 explained above.

In the present seventh embodiment, the optimum initial blank-holding force Fso and hydraulic pressure Pso are set as desired by the operator, and the diagnosis on the even distribution of the in-process blank-holding force Fs is easily effected under the thus selected condition. Further, the optimum range C during the operating cycle of the slide 20 can be known from the indication on the operator's control panel. The present embodiment may be modified to reciprocate the press slide 20 in the normal mode or at the normal pressing speed. In this case, the diagnosis according to the equation (9) may be effected on the basis of the pneumatic and hydraulic pressures Pa, Ps when the LOWER STROKE END signal SD is generated, or when the slide 20 is located at any other suitable point during its operating stroke.

Figure 16:
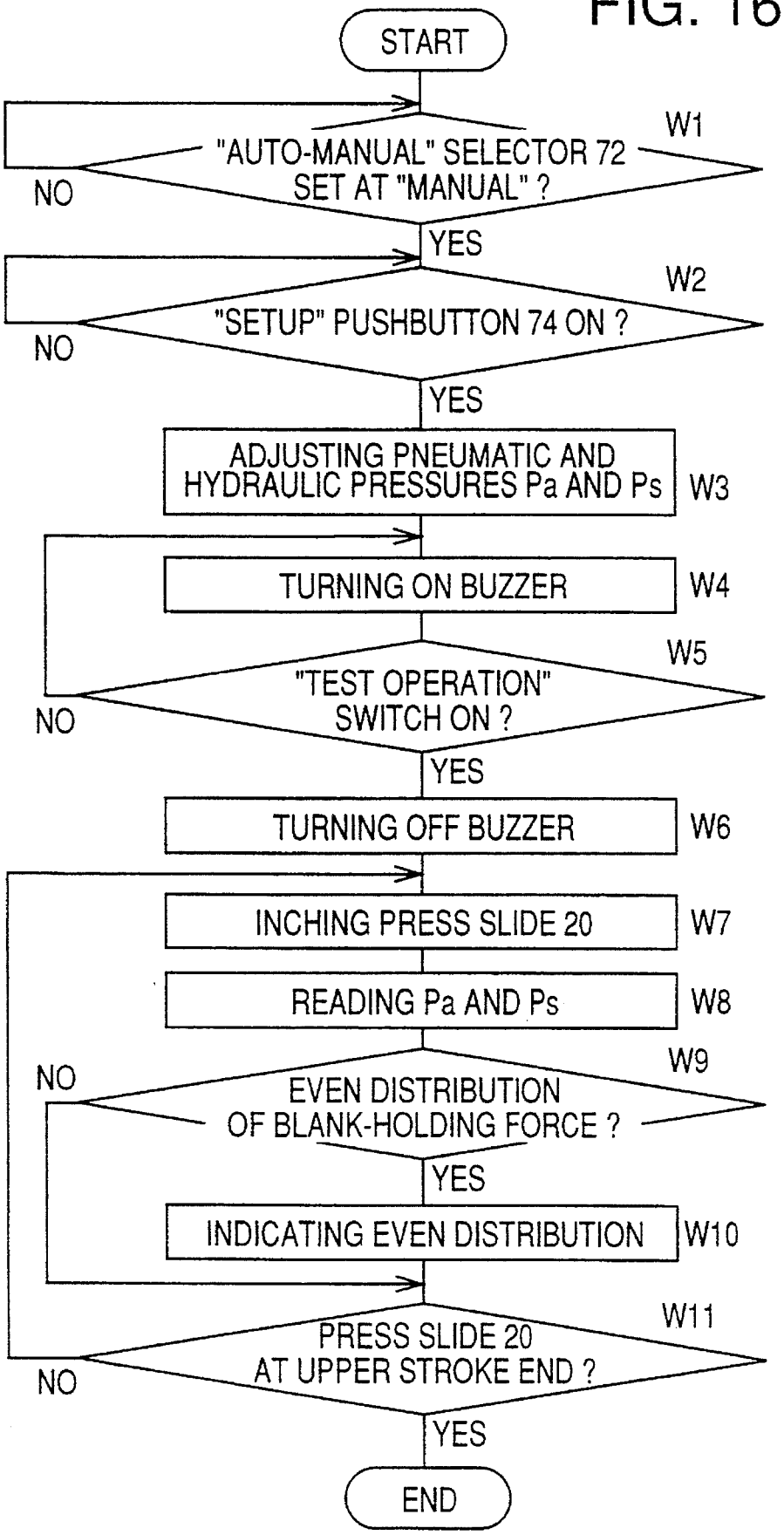
FIG. 16 is a flow chart showing yet another embodiment of the invention.
Figure 17:
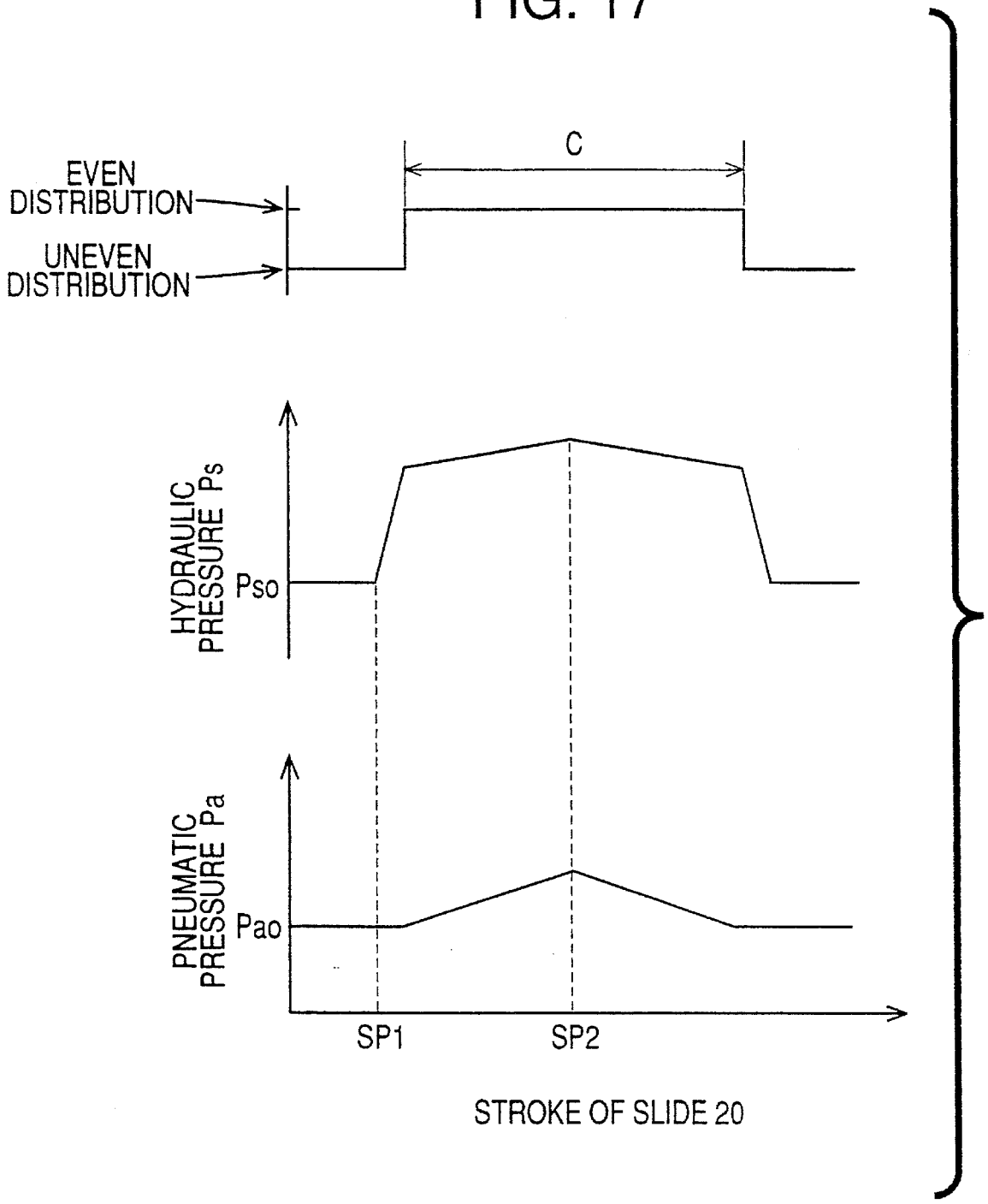
FIG. 17 is a graph indicating an example of data provided on a display of the diagnosing apparatus in the embodiment of FIG. 16.

In the present embodiment of FIGS. 16 and 17, the portion of the control unit 62 assigned to implement step W8 cooperates with the pneumatic and hydraulic pressure sensors 39, 60 to constitute means for detecting the pneumatic and hydraulic pressures Pa, Ps, while the portion of the control unit 62 assigned to implement step W9 constitutes means for effecting the diagnosis on the even distribution of the blank-holding force Fs.

Figure 18:
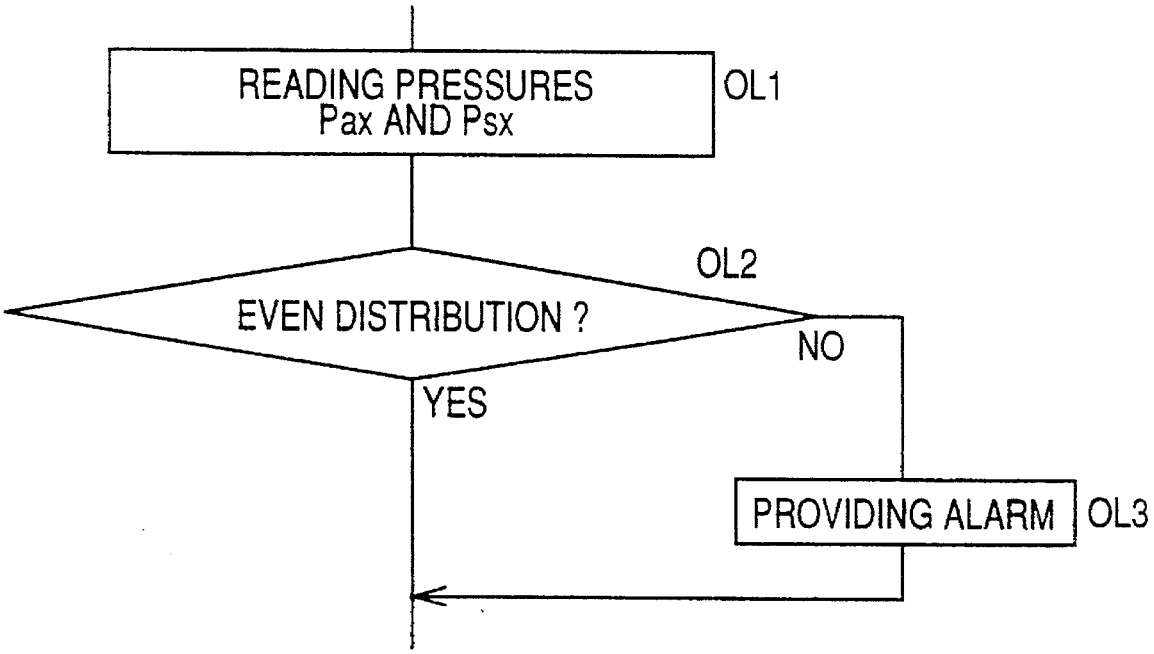
FIG. 18 is a fragmentary flow chart illustrating steps a diagnostic routine according to a further embodiment of the invention.

Reference is now made to FIG. 18 illustrating an eighth embodiment of the present invention, which is adapted to diagnose the cushioning device 44 during an actual production run of the press. The diagnostic routine includes step OL1 to detect and store the in-process pneumatic and hydraulic pressures Pax, Psx when the LOWER STROKE END signal SD is generated. Step OL1 is followed by step OL2 to determine whether the above equation (9) is satisfied, to thereby determine whether the current in-process blank-holding force Fs is evenly distributed or not. If the equation (9) is not satisfied, step OL3 is implemented to provide a suitable alarm, such as activation of an alarm light or buzzer, to inform the operator that the blank-holding force Fs is not evenly distributed.

In the embodiment of FIG. 18, the portion of the control unit 62 assigned to implement step OL1 constitutes means for detecting the in-process pneumatic and hydraulic pressures Pax, Psx, while the portion of the control unit 62 assigned to implement step OL2 constitutes means for 10 effecting the diagnosis. The portion of the control unit 62 assigned to implement step OL3 cooperates with the alarm light or buzzer to constitute means for providing an alarm.

While the present invention has been described above in detail in its presently preferred embodiments, it is to be understood that the invention may be otherwise embodied.

For instance, the indicator lights 78 provided on the operator's control panel 68 in the illustrated embodiments to indicate the optimum range of the blank-holding force may be replaced by various other indicator means, such as a liquid crystal display adapted to indicate the optimum range in color or in the form of a bar. A liquid crystal display or other indicator means may be provided to provide a two-dimensional indication of a graph as indicated in FIG. 8, to inform the operator of the relationship between the blank-holding force $Fs_n$ and the in-process hydraulic pressure $Psx_n$.

While the illustrated embodiments are adapted to decrement the blank-holding force $Fs_n$ from the highest value of 200 tons down to the lowest value of 20 tons, the blank-holding force may be incremented from 20 tons toward 200 tons. It is possible to provide suitable means that enables the operator to select the desired highest and lowest values between which the blank-holding force is decremented or incremented, and also the desired decrement or increment amount of the blank-holding force. The pneumatic pressure Pa may be decremented or incremented, rather than the blank-holding force $Fs_n$.

In the illustrated embodiments, the in-process blank-holding force Fs is changed by adjusting or changing the pneumatic pressure Pa according to the above equation (7) and on the basis of the set blank-holding force $Fs_n$. However, the in-process blank-holding force Fs may be detected by suitable strain sensing means such as strain gages attached to the plungers for reciprocating the press slide 20 or the machine frame. In this case, the diagnosis may be effected on the basis of the thus detected in-process blank-holding force Fs and the in-process hydraulic pressure Psx.

In the embodiments of FIGS. 6A, 6B, 11A and 11B, the blank-holding force Fs is decremented by the predetermined decrement amount ΔFs (20 tons), and the amounts of change $\Delta Psx_n$, $\Delta Psx_{n-1}$ of the hydraulic pressure Psx are obtained to effect the diagnosis. However, the diagnosis may be effected on the basis of ratios of the amounts of change $\Delta Psx_n$, $\Delta Psx_{n-1}$ with respect to the decrement or increment amount ΔFs, that is, on the basis of values $\Delta Psx_n/\Delta Fs$ and $\Delta Psx_{n-1}/\Delta Fs$. In this case, the decrement or increment amount ΔFs need not be constant.

In the embodiments of FIGS. 12A, 12B, 13A, 13B, the value $\Delta Fs/n \cdot As$ is obtained as the reference value $\Delta Psx^*$, with which the amount of change $\Delta Psx_n$ of the hydraulic pressure $Psx_n$ is compared to effect the diagnosis. However, a change rate $1/n \cdot As$ may be obtained as the reference with which a value $\Delta Psx_n/\Delta Fs$ is compared. The value $\Delta Psx_n/\Delta Fs$ represents a ratio of the change amount $\Delta Psx_n$ with respect to the decrement or increment amount ΔFs of the blank-holding force $Fs_n$. Further, the diagnosis may be effected by comparing a value $\Delta Psx_n/\Delta Pa$ with a reference $Aa/n \cdot As$, since $\Delta Fs = Aa \cdot \Delta Pa$.

Although the pneumatic cylinder 32 is used in the illustrated embodiments as a cushioning cylinder of the force generating means 42 for applying the blank-holding force Fs to the cushion platen, the present invention is applicable to a press of the type wherein the pneumatic cylinder 32 is replaced by a cushioning hydraulic cylinder which is adapted to discharge the pressurized working fluid at a predetermined relief pressure during a pressing cycle.

The present invention may be embodied with various other changes, modifications and improvements, which may occur to those skilled in the art, in the light of the foregoing teachings.

What is claimed is:

1. A method of diagnosing a cushioning device of a press having an upper die and a lower die which cooperate to perform a pressing action on a blank during a downward movement of said upper die, and a pressure member which cooperates with said upper die to hold said blank during said pressing action, said cushioning device including (a) force generating means for generating a blank-holding force, (b) a cushion platen disposed below said lower die and receiving said blank-holding force, (c) a plurality of balancing hydraulic cylinders disposed on said cushion platen and having fluid chambers communicating with each other, and (d) a plurality of cushion pins associated at lower ends thereof with said hydraulic cylinders, respectively, and supporting at upper ends thereof said pressure member, and wherein said blank is held by said upper die and said pressure member during said pressing action by said blank-holding force which is transmitted to said pressure member through said cushion platen, said hydraulic cylinders and said cushion pins such that said blank-holding force is substantially evenly distributed on all of said cushion pins by said hydraulic cylinders, said method comprising the steps of:

detecting a hydraulic pressure in said balancing hydraulic cylinders under operation to transmit said blank-holding force to said pressure member, as said blank-holding force is changed; and diagnosing said cushioning device on the basis of a rate of change of the detected hydraulic pressure with a change of said blank-holding force, regarding an optimum range of said blank-holding force in which said rate of change of said detected hydraulic pressure is substantially constant.

2. A method according to claim 1, further comprising a step of indicating said optimum range of said blank-holding force.

3. A method according to claim 1, wherein said press further has a press slide which carries said upper die, and where said step of detecting a hydraulic pressure in said balancing hydraulic cylinders comprises changing an initial value of said blank-holding force which is present when said press slide is located at a position at which said upper die contacts with said blank on said pressure ring, and detecting an in-process value of said hydraulic pressure when said press slide is located at a lower stroke end thereof.

4. A method according to claim 1, wherein said press further has a press slide which carries said upper die, and wherein said step of detecting a hydraulic pressure in said balancing hydraulic cylinders comprises changing an in-process value of said blank-holding force which is present when said press slide is located at a lower stroke end thereof, and detecting an in-process value of said hydraulic pressure when said press slide is located at said lower stroke end.

5. A method according to claim 1, further comprising a step of calculating said rate of change of said detected hydraulic pressure with said change of said blank-holding force.

6. A method according to claim 5, wherein said step of detecting a hydraulic pressure in said balancing hydraulic cylinders comprises changing said blank-holding force a predetermined number of times, by a predetermined amount for each change of said blank-holding force, and said step of calculating said rate of change of said detected hydraulic pressure comprises calculating said rate of change of said hydraulic pressure by calculating an amount of change of said blank-holding force corresponding to said predetermined amount of each change of said blank-holding force.

7. An apparatus for diagnosing a cushioning device of a press having an upper die and a lower die which cooperate to perform a pressing action on a blank during a downward movement of said upper die, and a pressure member which cooperates with said upper die to hold said blank during said pressing action, said cushioning device including (a) force generating means for generating a blank-holding force, (b) a cushion platen disposed below said lower die and receiving said blank-holding force, (c) a plurality of balancing hydraulic cylinders disposed on said cushion platen and having fluid chambers communicating with each other, and (d) a plurality of cushion pins associated at lower ends thereof with said hydraulic cylinders, respectively, and supporting at upper ends thereof said pressure member, and wherein said blank is held by said upper die and said pressure member during said pressing action by said blank-holding force which is transmitted to said pressure member through said cushion platen, said hydraulic cylinders and said cushion pins such that said blank-holding force is substantially evenly distributed on all of said cushion pins by said hydraulic cylinders, said apparatus comprising:

force changing means for changing said blank-holding force generated by said force generating means;

hydraulic pressure detecting means for detecting said hydraulic pressure in said balancing hydraulic cylinder under operation to transmit said blank-holding force to said pressure member, as said blank-holding force is changed;

change rate calculating means for calculating a rate of change of said hydraulic pressure detected by said hydraulic pressure detecting means, as said blank-holding force is changed;

diagnosing means for diagnosing said cushioning device on the basis of said rate of change of the detected hydraulic pressure calculated by said change rate calculating means, regarding an optimum range of said blank-holding force in which said rate of change of said detected hydraulic pressure is substantially constant; and indicating means for indicating a result of a diagnosis effected by said diagnosing means.

8. An apparatus according to claim 7, wherein said indicating means indicates said optimum range of said blank-holding force determined by said diagnosing means.

9. An apparatus according to claim 8, wherein said diagnosing means comprises means for activating said indicating means to indicate said optimum range of said blank-holding force.

10. An apparatus according to claim 7, wherein said press further has a press slide which carries said upper die and wherein said force changing means changes an initial value of said blank-holding force which is present when said press slide is located at a position at which said upper die contacts with said blank on said pressure ring, said hydraulic pressure detecting means detecting an in-process value of said hydraulic pressure when said press slide is located at a lower stroke end thereof.

11. An apparatus according to claim 7, wherein said press further has a press slide which carries said upper die, and wherein said force changing means changes an in-process value of said blank-holding force which is present when said press slide is located at a lower stroke end thereof, said hydraulic pressure detecting means detecting an in-process value of said hydraulic pressure when said press slide is located at said lower stroke end.

12. An apparatus according to claim 7, wherein said force changing means changes said blank-holding force a predetermined number of times, by a predetermined amount for each change of said blank-holding force, and said change rate calculating means calculates said rate of change of said hydraulic pressure by calculating an amount of change of said blank-holding force corresponding to said predetermined amount of each change of said blank-holding force.

13. A method of diagnosing a cushioning device of a press having an upper die and a lower die which cooperate to perform a pressing action on a blank during a downward movement of said upper die, and a pressure member which cooperates with said upper die to hold said blank during said pressing action, said cushioning device including (a) force generating means for generating a blank-holding force, (b) a cushion platen disposed below said lower die and receiving said blank-holding force, (c) a plurality of balancing hydraulic cylinders disposed on said cushion platen and having fluid chambers communicating with each other, and (d) a plurality of cushion pins associated at lower ends thereof with said hydraulic cylinders, respectively, and supporting at upper ends thereof said pressure member, and wherein said blank is held by said upper die and said pressure member during said pressing action by said blank-holding force which is transmitted to said pressure member through said cushion platen, said hydraulic cylinders and said cushion pins such that said blank-holding force is substantially evenly distributed on all of said cushion pins by said hydraulic cylinders, said method comprising the steps of:

detecting a hydraulic pressure in said balancing hydraulic cylinders during operation thereof to transmit said blank-holding force to said pressure member, as said blank-holding force is changed;

calculating a reference value on the basis of specifications of said cushioning device, said reference value representing a rate of change of the detected hydraulic pressure with a change of said blank-holding force which occurs within an optimum range in which said blank-holding force is substantially evenly distributed on all of said cushion pins by said hydraulic cylinders;

calculating said rate of change of said detected hydraulic pressure as said blank-holding force is changed; and diagnosing said cushioning device such that a range of said blank-holding force in which the calculated rate of change of said hydraulic pressure is substantially equal to said reference value is determined as said optimum range.

14. A method according to claim 13, further comprising a step of indicating said optimum range of said blank-holding force.

15. A method according to claim 13, wherein said specifications of said cushioning device includes a number of said cushion pins and a pressure-receiving area of each of said hydraulic cylinders.

16. A method according to claim 13, wherein step of detecting a hydraulic pressure in said balancing hydraulic cylinders comprises changing said blank-holding force a predetermined number of times, by a predetermined amount for each change of said blank-holding force, and said step of calculating said rate of change of said detected hydraulic pressure comprising calculating said rate of change of said hydraulic pressure by calculating an amount of change of said blank-holding force corresponding to said predetermined amount of each change of said blank-holding force.

17. A method according to claim 13, wherein said press further has a press slide which carries said upper die, and wherein said step of detecting a hydraulic pressure in said balancing hydraulic cylinders comprises changing an initial value of said blank-holding force which is present when said press slide is located at a position at which said upper die contacts said blank on said pressure ring, and detecting an in-process value of said hydraulic pressure when said press slide is located at a lower stroke end thereof.

18. A method according to claim 13, wherein said press further has a press slide which carries said upper die, and wherein said step of detecting a hydraulic pressure in said balancing hydraulic cylinders comprises changing an in-process value of said blank-holding force which is present when said press slide is located at a lower stroke end thereof, and detecting an in-process value of said hydraulic pressure when said press slide is located at said lower stroke end.

19. An apparatus for diagnosing a cushioning device of a press having an upper die and a lower die which cooperate to perform a pressing action on a blank during a downward movement of said upper die, and a pressure member which cooperates with said upper die to hold said blank during said pressing action, said cushioning device including (a) force generating means for generating a blank-holding force, (b) a cushion platen disposed below said lower die and receiving said blank-holding force, (c) a plurality of balancing hydraulic cylinders disposed on said cushion platen and having fluid chambers communicating with each other, and (d) a plurality of cushion pins associated at lower ends thereof with said hydraulic cylinders, respectively, and supporting at upper ends thereof said pressure member, and wherein said blank is held by said upper die and said pressure member during said pressing action by said blank-holding force which is transmitted to said pressure member through said cushion platen, said hydraulic cylinders and said cushion pins such that said blank-holding force is substantially evenly distributed on all of said cushion pins by said hydraulic cylinders, said apparatus comprising:

force changing means for changing said blank-holding force generated by said force generating means;

hydraulic pressure detecting means for detecting a hydraulic pressure in said balancing hydraulic cylinders during operation thereof to transmit said blank-holding force to said pressure member, as said blank-holding force is changed;

reference calculating means for calculating a reference value on the basis of specifications of said cushioning device, said reference value representing a rate of change of the detected hydraulic pressure with a change of said blank-holding force which occurs within an optimum range in which said blank-holding force is substantially evenly distributed on all of said cushion pins by said hydraulic cylinders;

change rate calculating means for calculating said rate of change of said detected hydraulic pressure as said blank-holding force is changed;

diagnosing means said cushioning device such that a range of said blank-holding force in which the calculated rate of change of said hydraulic pressure is substantially equal to said reference value is determined as said optimum range; and indicating means for indicating a result of a diagnosis effected by said diagnosing means.

20. An apparatus according to claim 19, wherein said indicating means indicates said optimum range of said blank-holding force determined by said diagnosing means.

21. An apparatus according to claim 20, wherein said diagnosing means comprises means for activating said indicating means to indicate said optimum range of said blank-holding force.

22. An apparatus according to claim 19, wherein said specifications of said cushioning device includes a number of said cushion pins and a pressure-receiving area of each of said hydraulic cylinders.

23. An apparatus according to claim 19, wherein said force changing means changes said changes said blank-holding force a predetermined number of times, by a predetermined amount for each change of said blank-holding force, and said change rate calculating means calculates said rate of change of said detected hydraulic pressure by calculating an amount of change of said blank-holding force corresponding to said predetermined amount of each change of said blank-holding force.

24. An apparatus according to claim 19, wherein said press further has a press slide which carries said upper die, and said force changing means changes an initial value of said blank-holding force which is present when said press slide is located at a position at which said upper die contacts said blank on said pressure ring, said hydraulic pressure detecting means detecting an in-process value of said hydraulic pressure when said press slide is located at a lower stroke end thereof.

25. An apparatus according to claim 19, wherein said press further has a press slide which carries said upper die, and wherein said force changing means changes an in-process value of said blank-holding force which is present when said press slide is located at a lower stroke end thereof, said hydraulic pressure detecting means detecting an in-process value of said hydraulic pressure when said press slide is located at said lower stroke end.

26. A method of diagnosing a cushioning device of a press having an upper die and a lower die which cooperate to perform a pressing action on a blank during a downward movement of said upper die, and a pressure member which cooperates with said upper die to hold said blank during said pressing action, said cushioning device including (a) force generating means for generating a blank-holding force, (b) a cushion platen disposed below said lower die and receiving said blank-holding force, (c) a plurality of balancing hydraulic cylinders disposed on said cushion platen and having fluid chambers communicating with each other, and (d) a plurality of cushion pins associated at lower ends thereof with said hydraulic cylinders, respectively, and supporting at upper ends thereof said pressure member, and wherein said blank is held by said upper die and said pressure member during said pressing action by said blank-holding force which is transmitted to said pressure member through said cushion platen, said hydraulic cylinders and said cushion pins such that said blank-holding force is substantially evenly distributed on all of said cushion pins by said hydraulic cylinders, said method comprising the steps of:

detecting said blank-holding force generated by said force generating means;

detecting a hydraulic pressure in said balancing hydraulic cylinders during operation thereof to transmit said blank-holding force to said pressure member;

diagnosing said cushioning device such that the detected blank-holding force is held within an optimum range in which said blank-holding force is substantially evenly distributed on all of said cushion pins by said balancing hydraulic cylinders, if said detected blank-holding force and the detected hydraulic pressure of said hydraulic cylinders satisfy a predetermined formula which is formulated on the basis of specifications of said cushioning device.

27. A method according to claim 26, further comprising a step of indicating said optimum range of said blank-holding force.

28. A method according to claim 26, wherein said said force generating means includes a cushioning cylinder to generate said blank-holding force, and wherein said specifications of said cushioning device includes a number of said cushion pins, a pressure-receiving area of each of said hydraulic cylinders, a pressure-receiving area of said cushioning cylinder, and a total weight of said balancing hydraulic cylinders and said cushion platen.

29. A method according to claim 28, wherein said cushioning cylinder is a pneumatic cylinder.

30. A method according to claim 29, wherein said step of detecting said blank-holding force comprises detecting a pneumatic pressure in said pneumatic cylinder which generates said blank-holding force.

31. A method according to claim 26, wherein said press further has a press slide which carries said upper die, and wherein said step of detecting said blank-holding force and said step of detecting a hydraulic pressure in said balancing hydraulic cylinders comprise setting an initial value of said blank-holding force which is present when said press slide is located at a position at which said upper die contacts said blank on said pressure ring.

32. A method according to claim 31, wherein said steps of detecting said in-process values of said blank-holding force and said hydraulic pressure comprise detecting in-process values of said blank-holding force and said hydraulic pressure when said press slide is located at a lower stroke end thereof.

33. A method according to claim 31, wherein said steps of detecting said in-process values of said blank-holding force and said hydraulic pressure comprise detecting in-process values of said blank-holding force and said hydraulic pressure while said press slide is reciprocated between upper and lower stroke ends thereof in an inching mode of the press.

34. A method according to claim 33, wherein said press further has a press slide which carries said upper die, said method further comprising a step of indicating a relationship between said detected blank-holding force and said hydraulic pressure and a position of said press slide between upper and lower stroke ends thereof.

35. A method according to claim 26, wherein said press further has a press slide which carries said upper die, and wherein said step of detecting said blank-holding force and said step of detecting a hydraulic pressure in said balancing hydraulic cylinders comprise setting an initial value of said blank-holding force which is present when said press slide is located at a lower stroke end thereof, and detecting in-process values of said blank-holding force and said hydraulic pressure when said press slide is located at said lower stroke end.

36. A method according to claim 26, further comprising a step of indicating that said detected blank-holding force is not held within said optimum range.

37. An apparatus for diagnosing a cushioning device of a press having an upper die and a lower die which cooperate to perform a pressing action on a blank during a downward movement of said upper die, and a pressure member which cooperates with said upper die to hold said blank during said pressing action, said cushioning device including (a) force generating means for generating a blank-holding force, (b) a cushion platen disposed below said lower die and receiving said blank-holding force, (c) a plurality of balancing hydraulic cylinders disposed on said cushion platen and having fluid chambers communicating with each other, and (d) a plurality of cushion pins associated at lower ends thereof with said hydraulic cylinders, respectively, and supporting at upper ends thereof said pressure member, and wherein said blank is held by said upper die and said pressure member during said pressing action by said blank-holding force which is transmitted to said pressure member through said cushion platen, said hydraulic cylinders and said cushion pins such that said blank-holding force is substantially evenly distributed on all of said cushion pins by said hydraulic cylinders, said apparatus comprising:

force detecting means for detecting said blank-holding force generated by said force generating means;

hydraulic pressure detecting means for detecting a hydraulic pressure in said balancing hydraulic cylinders during operation thereof to transmit said blank-holding force to said pressure member;

diagnosing means for diagnosing said cushioning device such that the detected blank-holding force is held within an optimum range in which said blank-holding force is substantially evenly distributed on all of said cushion pins by said balancing hydraulic cylinders, if said detected blank-holding force and the detected hydraulic pressure of said hydraulic cylinders satisfy a predetermined formula which is formulated on the basis of specifications of said cushioning device.

38. An apparatus according to claim 37, further comprising step indicating means for indicating said optimum range of said blank-holding force.

39. An apparatus according to claim 37, wherein said said force generating means includes a cushioning cylinder to generate said blank-holding force, and wherein said specifications of said cushioning device includes a number of said cushion pins, a pressure-receiving area of each of said hydraulic cylinders, a pressure-receiving area of said cushioning cylinder, and a total weight of said balancing hydraulic cylinders and said cushion platen.

40. An apparatus according to claim 39, wherein said cushioning cylinder is a pneumatic cylinder.

41. An apparatus according to claim 40, wherein said force detecting means detects a pneumatic pressure in said pneumatic cylinder which generates said blank-holding force.

42. An apparatus according to claim 37, wherein said press further has a press slide which carries said upper die, and wherein said force detecting means and said hydraulic pressure detecting means comprise means for setting an initial value of said blank-holding force which is present when said press slide is located at a position at which said upper die contacts said blank on said pressure ring.

43. An apparatus according to claim 42, wherein said force detecting means and said hydraulic pressure detecting means comprise means for detecting in-process values of said blank-holding force and said hydraulic pressure when said press slide is located at a lower stroke end thereof.

44. An apparatus according to claim 42, wherein said force detecting means and said hydraulic pressure detecting means comprise means for detecting in-process values of said blank-holding force and said hydraulic pressure while said press slide is reciprocated between upper and lower ends thereof in an inching mode of the press.

45. An apparatus according to claim 44, wherein said press further has a press slide which carries said upper die, further comprising indicating means for indicating a relationship between said detected blank-holding force and said hydraulic pressure and a position of said press slide between upper and lower stroke ends thereof.

46. An apparatus according to claim 37, wherein said press further has a press slide which carries said upper die, and wherein said force detecting means and said hydraulic pressure detecting means comprise means for setting an initial value of said blank-holding force which is present when said press slide is located at a lower stroke end thereof, and means for detecting in-process values of said blank-holding force and said hydraulic pressure when said press slide is located at said lower stroke end.

47. An apparatus according to claim 37, further comprising indicating means for indicating that said detected blank-holding force is not held within said optimum range.

* * * * *

UNITED STATES PATENT AND TRADEMARK OFFICE

CERTIFICATE OF CORRECTION

PATENT NO. : 5,471,861

DATED : December 5, 1995

INVENTOR(S) : Kazunari Kirii

It is certified that error appears in the above-identified patent and that said Letters Patent is hereby corrected as shown below:

Claim 19, column 33, line 46, after "diagnosing means" insert --for diagnosing--.

Claim 23, column 33, line 66, the second occurrence of "changes said" should be deleted.

Signed and Sealed this

Twenty-seventh Day of August, 1996

Bruce Lehman

*Attest:*

BRUCE LEHMAN

*Attesting Officer*

*Commissioner of Patents and Trademarks*